US010392156B2

(12) United States Patent
McDonald et al.

(10) Patent No.: US 10,392,156 B2
(45) Date of Patent: Aug. 27, 2019

(54) RETURN SHIPPING SYSTEM

(71) Applicants: John McDonald, Fallbrook, CA (US); Myles Comerford, Irvine, CA (US); Frank Comerford, Irvine, CA (US)

(72) Inventors: John McDonald, Fallbrook, CA (US); Myles Comerford, Irvine, CA (US); Frank Comerford, Irvine, CA (US)

( * ) Notice: Subject to any disclaimer, the term of this patent is extended or adjusted under 35 U.S.C. 154(b) by 37 days.

(21) Appl. No.: 15/483,916

(22) Filed: Apr. 10, 2017

(65) Prior Publication Data

US 2018/0290787 A1 Oct. 11, 2018

(51) Int. Cl.

| | |
|---|---|
| ***B65D 5/20*** | (2006.01) |
| ***B65D 5/24*** | (2006.01) |
| ***B65D 5/36*** | (2006.01) |
| ***B65D 5/42*** | (2006.01) |
| ***B65D 5/50*** | (2006.01) |
| ***B65D 81/07*** | (2006.01) |
| ***B65D 81/133*** | (2006.01) |

(52) U.S. Cl.

CPC ..... *B65D 5/503* (2013.01); *B65D 5/2066* (2013.01); *B65D 5/2076* (2013.01); *B65D 5/241* (2013.01); *B65D 5/3614* (2013.01); *B65D 5/4266* (2013.01); *B65D 5/5021* (2013.01); *B65D 81/07* (2013.01); *B65D 81/133* (2013.01)

(58) Field of Classification Search

CPC ..... B65D 81/02; B65D 81/07; B65D 81/075; B65D 5/4266; B65D 81/133; B65D 5/2076; B65D 5/0005; B65D 5/503; B65D 5/2066; B65D 5/2071; B65D 5/241

USPC ..... 206/521–591; 229/101, 138

See application file for complete search history.

(56) References Cited

U.S. PATENT DOCUMENTS

| | | | |
|---|---|---|---|
| 1,821,692 | A | 9/1931 | Copeland |
| 2,012,131 | A | 8/1935 | Kondolf |

(Continued)

FOREIGN PATENT DOCUMENTS

| | | | |
|---|---|---|---|
| CA | 2776889 A1 * | 5/2011 | ..... B65D 5/5035 |
| DE | 299 21 203 | 2/2000 | |

(Continued)

OTHER PUBLICATIONS

GXT Green, "ECO-R$^3$SP Reusable Suspension Packaging", http://web.archive.org/web/20160425174511/http://www.gxtgreen.com/r3sp as archived Apr. 25, 2016 in 3 pages.

(Continued)

*Primary Examiner* — Chun Hoi Cheung

(74) *Attorney, Agent, or Firm* — Knobbe Martens Olson & Bear LLP

(57) ABSTRACT

A return shipping system can include an outer container and a collapsible shock absorbing frame which can include a resilient sheet attached thereto for providing retention or suspension packaging of an article to be shipped within the outer container. The outer container can have a collapsed state suitable for shipping with the collapsible shock absorbing frame nested therein, the collapsible shock absorbing frame also in a collapsed state. The outer container can have an erect or expanded state suitable for shipping with the collapsible shock absorbing frame nested therein, the collapsible shock absorbing frame being in a locked or deployed state and configured to retain an article for shipping within the outer container.

26 Claims, 16 Drawing Sheets

(56) References Cited

U.S. PATENT DOCUMENTS 2,161,128 A 6/1939 Boyle
2,746,665 A 4/1950 Wiggins
2,617,573 A 11/1952 Nahoom
2,723,796 A 11/1955 Malmgren
2,797,855 A 7/1957 Moore
2,807,265 A 9/1957 Oliva et al.
2,948,455 A 8/1960 Frankenstein
2,956,672 A 10/1960 Kirkpatrick
3,047,137 A 7/1962 Kindseth
3,089,631 A 5/1963 Tyrseck et al.
3,285,493 A 11/1966 Coe et al.
3,326,410 A 6/1967 Asenbauer
3,345,643 A 10/1967 Bradley
3,434,650 A 3/1969 Goings
3,438,562 A * 4/1969 Wright ..... B65D 5/0005 229/117.02
3,502,488 A * 3/1970 Bridgford ..... A21B 3/131 229/138
3,695,421 A 10/1972 Wood
3,706,174 A 12/1972 Young et al.
3,853,220 A 12/1974 Luray
3,854,650 A 12/1974 Hanaue
3,899,119 A 8/1975 Roccaforte
3,905,474 A 9/1975 Haibara
3,917,108 A 11/1975 Thurman
3,923,578 A 12/1975 Hair
3,994,433 A 11/1976 Jenkins et al.
4,014,292 A * 3/1977 Coughlin ..... A01K 1/0125 119/168
4,034,908 A 7/1977 Forbes et al.
4,077,518 A 3/1978 Kisslinger et al.
4,155,453 A 5/1979 Ono
4,212,703 A 7/1980 D'Amico et al.
4,272,009 A * 6/1981 Bamburg ..... B65D 5/0005 229/101
4,335,817 A 6/1982 Bahr
4,379,008 A 4/1983 Gross et al.
4,606,460 A 8/1986 Luray
4,698,246 A 10/1987 Gibbons et al.
4,801,774 A 1/1989 Hart
4,806,398 A 2/1989 Martin, Jr.
4,830,272 A 5/1989 Wear et al.
4,852,743 A 8/1989 Ridgeway
4,886,299 A 12/1989 Ducorday
4,923,065 A 5/1990 Ridgeway
5,024,536 A 6/1991 Hill
5,029,900 A 7/1991 Axelrod
5,046,659 A 9/1991 Warburton
5,050,766 A * 9/1991 Groh ..... B65D 5/0005 229/101
5,056,665 A 10/1991 Boecker et al.
5,071,009 A 12/1991 Ridgeway
5,076,436 A 12/1991 Bortolani et al.
5,080,497 A 1/1992 Peppiatt
5,183,159 A 2/1993 Hojnacki et al.
5,207,327 A 5/1993 Brondos
5,211,290 A 5/1993 Janus et al.
5,217,159 A 6/1993 Calvert et al.
5,218,510 A 6/1993 Bradford
5,223,121 A 6/1993 Dickie et al.
5,226,542 A 7/1993 Boecker et al.
5,226,734 A 7/1993 Scott et al.
5,251,760 A 10/1993 Smith et al.
5,301,872 A 4/1994 Tusing et al.
5,318,219 A 6/1994 Smith
5,322,168 A 6/1994 Kataoka
5,323,896 A 6/1994 Jones
5,356,007 A 10/1994 Feldt
5,372,257 A 12/1994 Beauchamp et al.
5,388,701 A 2/1995 Ridgeway
5,394,985 A 3/1995 Van Hest
5,405,000 A 4/1995 Hagedon et al.
5,467,916 A 11/1995 Beales
5,474,230 A 12/1995 Yotukura
5,492,223 A 2/1996 Boardman et al.
5,524,789 A 6/1996 Jackman
5,562,228 A 10/1996 Ericson
5,579,917 A 12/1996 Lofgren et al.
5,641,068 A 6/1997 Warner
5,669,506 A 9/1997 Lofgren et al.
5,676,245 A 10/1997 Jones
5,678,695 A 10/1997 Ridgeway
5,694,744 A 12/1997 Jones
5,722,541 A 3/1998 Lofgren et al.
5,731,021 A 3/1998 Spector
5,738,218 A 4/1998 Gonzales
5,762,200 A 6/1998 Goudreau
5,769,235 A 6/1998 Keach et al.
5,788,081 A 8/1998 Bates et al.
5,797,493 A 8/1998 Watson
5,803,267 A 9/1998 Tu et al.
5,823,348 A 10/1998 Phillips et al.
5,823,352 A 10/1998 Mena et al.
5,893,462 A 4/1999 Ridgeway
5,894,932 A 4/1999 Harding et al.
5,934,473 A 8/1999 Belshé
5,934,474 A 8/1999 Renninger et al.
5,954,203 A 9/1999 Marconi
5,967,327 A 10/1999 Jones
RE36,412 E 11/1999 Jones
5,975,307 A * 11/1999 Harding ..... B65D 81/075 206/583
5,988,387 A 11/1999 Staal et al.
6,006,917 A 12/1999 Loeffler
6,010,003 A 1/2000 Wilkinson
6,047,831 A 4/2000 Jones
6,073,761 A 6/2000 Jones
6,079,563 A 6/2000 Katchmazenski
6,116,501 A 9/2000 Hupp
6,119,863 A 9/2000 Lofgren et al.
6,119,929 A 9/2000 Rose
6,148,590 A 11/2000 Ridgeway et al.
6,148,591 A 11/2000 Ridgeway et al.
6,158,589 A 12/2000 Smith et al.
6,164,821 A 12/2000 Randall
6,206,194 B1 3/2001 Beneroff et al.
6,223,901 B1 5/2001 Lofgren et al.
6,244,441 B1 6/2001 Ahlgren
6,289,655 B1 9/2001 Ridgeway et al.
6,302,274 B1 10/2001 Ridgeway
6,308,828 B1 10/2001 Jones
6,311,843 B1 11/2001 Smith et al.
6,311,844 B1 11/2001 Ridgeway et al.
6,325,239 B2 12/2001 Randall et al.
6,364,199 B1 4/2002 Rose
6,394,336 B1 * 5/2002 Beneroff ..... B65D 5/0005 229/101
6,398,412 B2 6/2002 Wedi et al.
6,467,624 B1 10/2002 Lofgren et al.
6,488,153 B1 12/2002 Morris
6,675,973 B1 1/2004 McDonald et al.
6,676,009 B1 1/2004 Rose
6,676,293 B2 1/2004 Ferris
6,837,420 B2 1/2005 Westerman et al.
6,899,229 B2 5/2005 Dennison et al.
6,913,147 B2 7/2005 Mueller et al.
6,920,981 B2 7/2005 Lofgren et al.
6,942,101 B2 9/2005 Lofgren et al.
7,000,774 B2 2/2006 Bryant
7,086,534 B2 8/2006 Roesel et al.
7,096,647 B2 8/2006 De Barbuat et al.
7,114,618 B2 10/2006 Arnold
7,124,555 B2 10/2006 Torre
7,140,773 B2 * 11/2006 Becker ..... B65D 5/5088 383/99
7,150,356 B2 12/2006 Lofgren et al.
7,192,640 B2 3/2007 Holbert et al.
7,255,261 B2 8/2007 Mesly
7,290,662 B2 11/2007 Lofgren et al.
7,293,695 B2 11/2007 Stier
7,296,681 B2 11/2007 McDonald et al.
7,299,926 B2 11/2007 Russel et al.
7,398,884 B2 7/2008 Stegner et al.

(56) References Cited

U.S. PATENT DOCUMENTS

| | | | | |
|---|---|---|---|---|
| 7,452,316 | B2 | 11/2008 | Cals et al. | |
| 7,478,514 | B2 | 1/2009 | Wenz | |
| 7,654,391 | B2 | 2/2010 | Langer et al. | |
| 7,669,716 | B2 | 3/2010 | Lightner et al. | |
| 7,673,751 | B2 | 3/2010 | Keiger | |
| 7,694,496 | B2 | 4/2010 | Keiger et al. | |
| 7,731,032 | B2 | 6/2010 | McDonald et al. | |
| 7,743,924 | B2 | 6/2010 | McDonald et al. | |
| 7,753,209 | B2 | 7/2010 | McDonald et al. | |
| 7,770,734 | B2 | 8/2010 | Saitou et al. | |
| 7,775,367 | B2 | 8/2010 | McDonald et al. | |
| 7,784,614 | B2 | 8/2010 | Yen | |
| 7,882,956 | B2 | 2/2011 | McDonald et al. | |
| 7,918,339 | B2 | 4/2011 | Kashiwabara | |
| 7,931,151 | B2 | 4/2011 | McDonald et al. | |
| 8,016,112 | B2 | 9/2011 | Kasiwabara | |
| 8,028,838 | B2 | 10/2011 | McDonald et al. | |
| 8,123,039 | B2 | 2/2012 | McDonald et al. | |
| 8,127,928 | B2 | 3/2012 | Stack, Jr. et al. | |
| 8,177,067 | B2 | 5/2012 | McDonald et al. | |
| 8,181,787 | B2 | 5/2012 | Klos | |
| 8,215,488 | B2 | 7/2012 | Klos | |
| 8,235,216 | B2 | 8/2012 | McDonald et al. | |
| 8,316,760 | B2 | 11/2012 | Berthault | |
| 8,408,412 | B2 | 4/2013 | Hong | |
| 8,499,937 | B2 | 8/2013 | McDonald et al. | |
| 8,505,731 | B2 | 8/2013 | McDonald et al. | |
| 8,579,184 | B2 | 11/2013 | Pettersson et al. | |
| 8,627,958 | B2 | 1/2014 | McDonald et al. | |
| 8,714,357 | B2 | 5/2014 | Ridgeway | |
| 8,727,123 | B1 * | 5/2014 | Roberts | B65D 81/075 206/521 |
| 8,752,707 | B2 | 6/2014 | McDonald et al. | |
| 8,783,459 | B1 | 7/2014 | Marcinkowski | |
| 9,067,722 | B2 | 6/2015 | McDonald et al. | |
| 9,126,743 | B2 | 9/2015 | Roberts | |
| 9,150,343 | B2 | 10/2015 | Roberts | |
| 9,199,761 | B2 | 12/2015 | McDonald et al. | |
| 9,463,915 | B2 | 10/2016 | McDonald et al. | |
| 2001/0047950 | A1 | 12/2001 | Beneroff et al. | |
| 2003/0034273 | A1 | 2/2003 | Auclair | |
| 2003/0116468 | A1 * | 6/2003 | Schwester | B65D 5/503 206/592 |
| 2003/0209463 | A1 | 11/2003 | Halpin | |
| 2003/0213717 | A1 | 11/2003 | Kanai | |
| 2003/0234207 | A1 | 12/2003 | Koike | |
| 2004/0086692 | A1 | 5/2004 | Clark | |
| 2004/0129601 | A1 | 7/2004 | Lofgren et al. | |
| 2004/0140243 | A1 | 7/2004 | Roesel et al. | |
| 2004/0178113 | A1 | 9/2004 | Lofgren et al. | |
| 2005/0011807 | A1 | 1/2005 | Dennison et al. | |
| 2005/0121354 | A1 | 6/2005 | Gillis et al. | |
| 2005/0252825 | A1 | 11/2005 | Lofgren et al. | |
| 2005/0286816 | A1 | 12/2005 | Laske | |
| 2006/0032777 | A1 | 2/2006 | Russell et al. | |
| 2006/0042995 | A1 | 3/2006 | McGrath et al. | |
| 2006/0102515 | A1 | 5/2006 | McDonald et al. | |
| 2006/0285777 | A1 | 12/2006 | Howell et al. | |
| 2007/0237863 | A1 | 10/2007 | Langen | |
| 2007/0284281 | A1 | 12/2007 | Shimazu et al. | |
| 2008/0110788 | A1 | 5/2008 | Keiger | |
| 2008/0110794 | A1 | 5/2008 | Anderson et al. | |
| 2008/0223750 | A1 | 9/2008 | McDonald et al. | |
| 2008/0230592 | A1 | 9/2008 | Cavell et al. | |
| 2009/0188833 | A1 | 7/2009 | Klos | |
| 2009/0242448 | A1 | 10/2009 | Keiger | |
| 2009/0308880 | A1 | 12/2009 | Sims et al. | |
| 2010/0001056 | A1 | 1/2010 | Chandaria | |
| 2010/0192519 | A1 | 8/2010 | Keiger | |
| 2010/0200453 | A1 | 8/2010 | Keiger | |
| 2010/0276330 | A1 | 11/2010 | McDonald et al. | |
| 2011/0068042 | A1 | 3/2011 | Palumbo | |
| 2011/0095076 | A1 | 4/2011 | Knighton | |
| 2011/0108448 | A1 | 5/2011 | Goodrich | |
| 2011/0139673 | A1 | 6/2011 | Klos | |
| 2012/0045558 | A1 | 2/2012 | Fanfani et al. | |
| 2012/0125807 | A1 | 5/2012 | Jones et al. | |
| 2012/0181213 | A1 | 7/2012 | Klos | |
| 2012/0193263 | A1 | 8/2012 | Takahashi | |
| 2012/0193405 | A1 | 8/2012 | McDonald et al. | |
| 2012/0211388 | A1 | 8/2012 | Orgeldinger | |
| 2012/0234723 | A1 | 9/2012 | Klos | |
| 2013/0043298 | A1 | 2/2013 | Takahashi | |
| 2013/0048533 | A1 | 2/2013 | McDonald et al. | |
| 2013/0091807 | A1 | 4/2013 | McDonald et al. | |
| 2013/0137562 | A1 | 5/2013 | Penttinen et al. | |
| 2013/0233752 | A1 | 9/2013 | Hammerschmidt | |
| 2013/0284733 | A1 | 10/2013 | Samprathi | |
| 2014/0183097 | A1 | 7/2014 | Leroy et al. | |
| 2014/0284248 | A1 | 9/2014 | Klos | |
| 2014/0360913 | A1 | 12/2014 | McDonald et al. | |
| 2015/0239635 | A1 | 8/2015 | McDonald et al. | |
| 2015/0266639 | A1 | 9/2015 | McDonald et al. | |
| 2015/0266642 | A1 | 9/2015 | McDonald et al. | |
| 2015/0314936 | A1 | 11/2015 | Stack, Jr. et al. | |
| 2016/0016685 | A1 | 1/2016 | Bauernfeind | |
| 2016/0159550 | A1 | 6/2016 | McDonald et al. | |
| 2018/0002095 | A1 | 1/2018 | McDonald et al. | |
| 2018/0208350 | A1 * | 7/2018 | Ertmer | B65D 5/0005 |
| 2018/0244424 | A1 * | 8/2018 | Perella | B65D 5/3664 |

FOREIGN PATENT DOCUMENTS

| | | |
|---|---|---|
| DE | 101 05 487 | 8/2002 |
| DE | 202 17 626 | 1/2003 |
| EP | 0 980 334 | 8/2002 |
| EP | 1 431 196 | 6/2004 |
| EP | 1 561 693 | 8/2005 |
| EP | 1 657 166 | 5/2006 |
| EP | 1 657 167 | 5/2006 |
| EP | 2 546 170 | 1/2013 |
| JP | 05-305956 | 11/1993 |
| JP | 2004-231228 | 8/2004 |
| JP | 2005-146112 | 6/2005 |
| SU | 827346 A1 | 5/1981 |
| WO | WO 00/053499 | 9/2000 |
| WO | WO 00/064772 | 11/2000 |
| WO | WO 2006/081360 | 8/2006 |
| WO | WO 2007/127243 | 11/2007 |
| WO | WO 2008/070734 | 6/2008 |
| WO | WO 2008/115829 | 9/2008 |
| WO | WO 2013/150312 | 10/2013 |
| WO | WO 2014/043569 | 3/2014 |
| WO | WO 2015/143175 | 9/2015 |

OTHER PUBLICATIONS

High-Tech Information Service Co., "Introduction of Packing Material 'High-Tech Cushion'", http://www.his-net.jp/ as printed Apr. 26, 2016 in 2 pages.

HiTec Cushion, http://hitec-cushion.his-net.jp/ as printed Apr. 26, 2016 in 2 pages.

HiTec Cushion, http://web.archive.org/web/20140301081401/http:/hitec-cushion.his-net.jp/ as archived Mar. 1, 2014 in 2 pages.

HiTec Cushion, "Base", https://web.archive.org/web/20130926211952/http:/hitec-cushion.his-net.jp/base/index.html as archived Sep. 26, 2013 in 1 page.

HiTec Cushion, "Eco", http://hitec-cushion.his-net.jp/base/eco.html as printed Apr. 26, 2016 in 1 page.

HiTec Cushion, "Eco", https://web.archive.org/web/20090714064204/http:/hitec-cushion.his-net.jp/base/eco.html as archived Jul. 14, 2009 in 1 page.

HiTec Cushion, "Product List", http://hitec-cushion,his-net.jp/main/ltlranu.html as printed Apr. 26, 2016 in 6 pages.

HiTec Cushion, "Introduction of Packing Material", http://hitec-cushion.his-net.jp/main/standard.html as printed Apr. 26, 2016 in 3 pages.

Japan Packaging Institute (JPI), "Accessories for Packing, 'High-Tech Cushion'", http://www.jpl.or.jp/saill/lpc/2007/japanese/026.htm as printed Apr. 26, 2016 in 1 page.

(56) References Cited

OTHER PUBLICATIONS

Resende, Patricia, "Startup to Bring Photo-Degradable Bags to Grocery Chains", http://www.bizjournals.com/boston/blog/mass-high-tech/2012/04/startup-to-bring-photo-degradable-bags.html, Apr. 12, 2012, pp. 2.

* cited by examiner

RETURN SHIPPING SYSTEM

BACKGROUND

Field of the Inventions

The present inventions are directed to return shipping systems that can be mailed to customers in a compact configuration, expanded, filled with an item, and then mailed back to the sender or another location.

Description of the Related Art

A variety of companies ship or mail to customers, nearly empty containers containing with some cushioning material, for assisting a customer in returning equipment by return shipment. For example, some companies provide this service for facilitating the return of delicate components, such as cable boxes, laptop computers, cell phones, etc. Using this service, a customer receives the empty box in the mail, inserts the device to be returned into the box, then mails the box to the appropriate location.

While return shipping service is convenient to the end user, shipping an empty box is expensive. This is because shipping costs are not solely determined by weight. Rather, shipping providers typically use a pricing schedule known as "dimensional weight costing". As an example, consider an empty box, weighing 1.1 pounds and having the dimensions of 19"×16"×5.5". Under a "dimensional weight" costing schedule, the above-noted box would be considered to encompass a volume of 1,672 cubic inches. The volume of the box is then divided by a constant, such as 194 cubic inches per pound, resulting in a "dimensional weight" of 8.62 pounds. This fictional 8.62-pound weight of the 1.1-pound box is then used as the basis for the price for shipping the box.

SUMMARY

An aspect of at least one of the embodiments disclosed herein includes the realization that the costs associated with shipping empty containers for return shipping services can be significantly reduced by providing a packaging solution that includes a collapsible outer shipping container and a collapsible shock absorbing frame. As such, both the collapsible outer shipping container and the collapsible shock absorbing frame can be collapsed or folded to reduced sizes and sent to a customer with a lower dimensional weight and thus a lower shipping cost. The customer can then open and expand both the collapsible outer shipping container and the collapsible shock absorbing frame, insert the article to be shipped into the expanded outer shipping container protected by the expanded shock-absorbing frame, then close the expanded outer shipping container and mail the container to the desired location. As such, shipping cost penalties associated with shipping a larger empty container can be avoided.

For example, in some of the embodiments disclosed herein, a return shipping container assembly that is configured to provide a 19"×16"×5.5" shipping container can be folded and compressed to a size of 19"×16"×1", when empty. As such, under the dimensional weight costing scenario noted above, the folded box would occupy a volume of approximately 304 cubic inches. Under the above-noted formula, the volume of 304 inches would be divided by 194 cubic inches per pound, resulting in a fictional weight of 1.57 pounds; a significant reduction from the 8.62 pound fictional weight associated with the fully expanded size.

Thus, in accordance with some embodiments, a return shipping system can comprise an outer container and a collapsible shock absorbing frame. The outer container is structurally configured to adopt a collapsed state for shipping and an expanded state for return shipping. The collapsible shock absorbing frame can have a collapsed state, a deployed state. When in the collapsed state, the collapsible shock absorbing frame fits into the outer container when the outer container is folded into the collapsed state. When in the deployed state, the collapsible shock absorbing frame is too large to fit within the collapsed outer container. However, when in the deployed state, the collapsible shock absorbing frame together with an article to be shipped, fits within the expanded outer container. The outer container can be closed and sealed around the collapsible shock absorbing frame and the article for shipping forming a proper shipping container for mailing or shipping.

In some embodiments, the collapsible shock absorbing frame comprises a locking fold line. A locking panel of the collapsible shock absorbing frame can be defined at least in part by the locking fold line. The locking panel can be folded along the locking fold line and thereby the collapsible shock absorbing frame can be converted from the deployed state into the locked configuration wherein the collapsible shock absorbing frame cannot be folded into the collapsed state without unfolding the locking panel. In addition, the locking panel can act as a stiffening member to the sidewall of the collapsible shock absorbing frame.

In some embodiments, the collapsible shock absorbing frame can be nested inside of the outer container and the outer container can be folded into the collapsed state and the folding motion of a plurality of sidewalls of the outer container can cause the collapsible shock absorbing frame into to be folded into the collapsed state. In such a collapsed state, the outer container and the folds can be sealed for shipping with the collapsible shock absorbing frame in the collapsed state.

In some embodiments, the inner container is nested within the outer container with the inner container in a locked configuration. The outer container cannot be folded into the collapsed state because interference with the collapsible shock absorbing frame in the locked configuration. In this configuration the outer container can be maintained in the expanded state and closed for shipping.

In some embodiments, the collapsible shock absorbing frame nests within the outer container when in the deployed state. In this aspect the outer container can be folded into the collapsed state together with the collapsible shock absorbing frame folded into the collapsed state within the outer container.

In some embodiments, the outer container comprises a fold line on each of its plurality of side walls wherein the outer container is folded between an expanded state and a collapsed state along the plurality of fold lines. In such aspects, the collapsible shock absorbing frame can be placed within the outer container when in the locked configuration with a top ridge of the collapsible shock absorbing frame above at least one of the fold lines on the outer container. Thus, the outer container cannot be folded down into the collapsed state with the collapsible shock absorbing frame in the locked configuration. The collapsible shock absorbing frame can be placed within the outer container when in the deployed state with the top ridge of the collapsible shock absorbing frame below or at least one of the fold lines on the outer container. Thus, when the outer container is folded down into the collapsed state, the collapsible shock absorbing frame can folded into the collapsed state from the deployed state.

DETAILED DESCRIPTION OF THE PREFERRED EMBODIMENT

In the following detailed description, terms of orientation such as "upper," "lower," "longitudinal," "horizontal," "vertical," "lateral," "midpoint," and "end" are used herein to simplify the description in the context of the illustrated embodiments. Because other orientations are possible, however, the present disclosure should not be limited to the illustrated orientations. Those skilled in the art will appreciate that other orientations of various components described herein are possible.

Return Shipping System

Figure 1A:
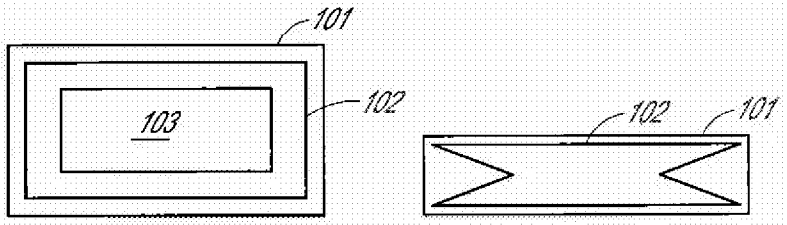
FIG. 1A includes schematic views of an embodiment of a return packaging system in the collapsed and expanded states.

FIG. 1*a* illustrates a return shipping system 100 comprising an outer container 101 in an expanded state and containing an article for shipping 103. The outer container in the expanded state can be substantially enclosed on all sides and configured for shipping through conventional post services such as the United States Postal Office and UPS, etc. Within the outer container 101, a shock absorbing assembly 102 in a deployed configuration provides protection for the article 103, for example, shock absorption protection against forces caused by drops, movements, or impacts during transit. The outer container 101 comprises an interior volume sized to accommodate both the shock absorbing frame 102 and the article 103 when in the expanded state.

Additionally, the terms "suspension" and "suspend" as used herein, are intended to refer to packaging configurations where an associated article is held in a position spaced from another member using a suspension technique, such as where an article is surrounded by stretchable films so as to be spaced away from rigid walls including walls of a container or box or walls of other rigid associated packaging members, devices, or mechanisms.

Further, the term "retention", as used herein, is intended to refer to packaging configurations wherein an associated article is held in the position pressed against another member, such as a frame member, a rigid member, or other packaging member, device, or mechanism, using techniques such as those including a stretchable, thin film pressing the article against the other member. Some of the embodiments of Packaging assembly is disclosed herein include aspects of both retention configurations and suspension configurations. Such embodiments might include, for example, stretchable, thin film material used to present article against a component made from rigid material but configured to be flexible and providing shock absorption. Such embodiments can be considered as a retention device and as a suspension device. Further, such embodiments can also be referred to as an "retention-suspension hybrid packaging configuration". Those skilled in the art will appreciate that other orientations of various components described herein are possible.

The outer container 101 can also have a collapsed state. In the collapsed state, the outer container 101 can be substantially enclosed on all sides and configured for shipping through conventional post services such as the United States Postal Office and UPS, etc. This enables the outer container to be sent through the post at a reduced rate as compared to the cost of sending the outer container through the post when in the expanded state. The outer container 101 in the collapsed state, defines an interior volume that is sized to accommodate the shock absorbing frame only when in a collapsed configuration. Thus, the shock absorbing frame in the deployed configuration will not fit within the outer container 101 when in the collapsed state.

Figure 1B:
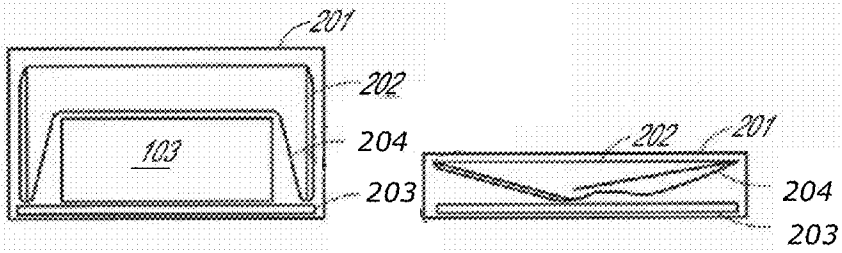
FIG. 1B includes schematic views of another embodiment of a return packaging system in the collapsed and expanded states.

FIG. 1*b* illustrates a variation of the shipping system 100, identified by the reference numeral 200. The return shipping system 200 can include an outer container 201 in an expanded state and containing an article for shipping 103. The outer container 201 in the expanded state can be substantially enclosed on all sides and configured for shipping through conventional post services such as the United States Postal Office and UPS, etc. Within the outer container 201, a shock absorbing frame 202 in a deployed configuration provides protection for the article 103 against forces caused by drops, movements, or impacts during transit.

Optionally, the outer container 201 can contain an optional lower frame 203. The lower frame 203 can be constructed of a layer or raised platform of corrugated cardboard or other materials and configurations. The lower frame 203 can be configured to provide additional spacing from an outer wall of the container 201 and thus additional protection and stability for the article 103 against forces caused by drops, movements, or impacts during transit.

The shock absorbing frame 202 can include a resilient sheet 204 that be applied to the frame 202 to provide protection for an article to be shipped by way of the suspension or retention principles of operation. The resilient sheet 204 can be formed of any flexible material, optionally in a sheet configuration. In some embodiments, the resilient sheet 204 can be formed of a layer of polyethylene film, low density polyethylene (LDPE), polyurethane, TPU, or virtually any polymer, or plastic film. In some embodiments, the resilient sheet 204 can be formed as straps or strips of material that provide the suspension and/or retention described herein for the article 103 being packaged. The density of the resilient sheet 204 can be varied to provide the desired retention characteristics such as overall strength, resiliency, and vibrational response. The density of the material used to form the resilient sheet 204 can be determined such that the resilient sheet 204 is substantially resilient when used to package a desired article. Optionally, the density of the material used to form the resilient sheet 204 can be determined such that the resilient sheet 204 is substantially non-resilient or non-resilient after being tightened around a desired article. In some embodiments including a non-resilient or substantially non-resilient flexible sheet, the associated frame member can be sized and configured to provide all or substantially all of the desired shock absorption. The material used to form resilient sheet 204 can be monolayer or multilayer sheet depending on the application. Other materials and configurations can be used to form the resilient sheet 204.

The resilient sheet 204 can extend across the frame 202 and provide additional protection and stability for the article 103 against forces caused by drops, movements, or impacts during transit. In some embodiments, the lower frame 203 can be placed within the outer container 201 and the article 103 place on the lower frame 203. The frame 202 in the deployed configuration can be placed or nested within the outer container 201 and the resilient sheet 204 pressed into contact with the article 103 and thereby secure in-place the article 103. Additionally, the resilient sheet 204 can be stretched around the article 103.

The outer container 201, when in the expanded state, defines an interior volume sized to accommodate the lower frame 203 (if present), the shock absorbing frame 202 and the article 103. The outer container 201 can also have a collapsed state. In the collapsed state, the outer container 201 can be substantially enclosed on all sides and configured for shipping through conventional post services such as the United States Postal Office and UPS, etc. This enables the outer container to be sent through the post at a reduced rate as compared to the cost of sending the outer container through the post when in the expanded state. The outer container 201 in the collapsed state defines an interior volume that is sized to accommodate the shock absorbing frame 202 (and lower frame 203 (if present)) only when in a collapsed configuration. Thus, the shock absorbing frame 202 in the deployed configuration will not fit within the outer container 101 when in the collapsed state.

Figure 1C:
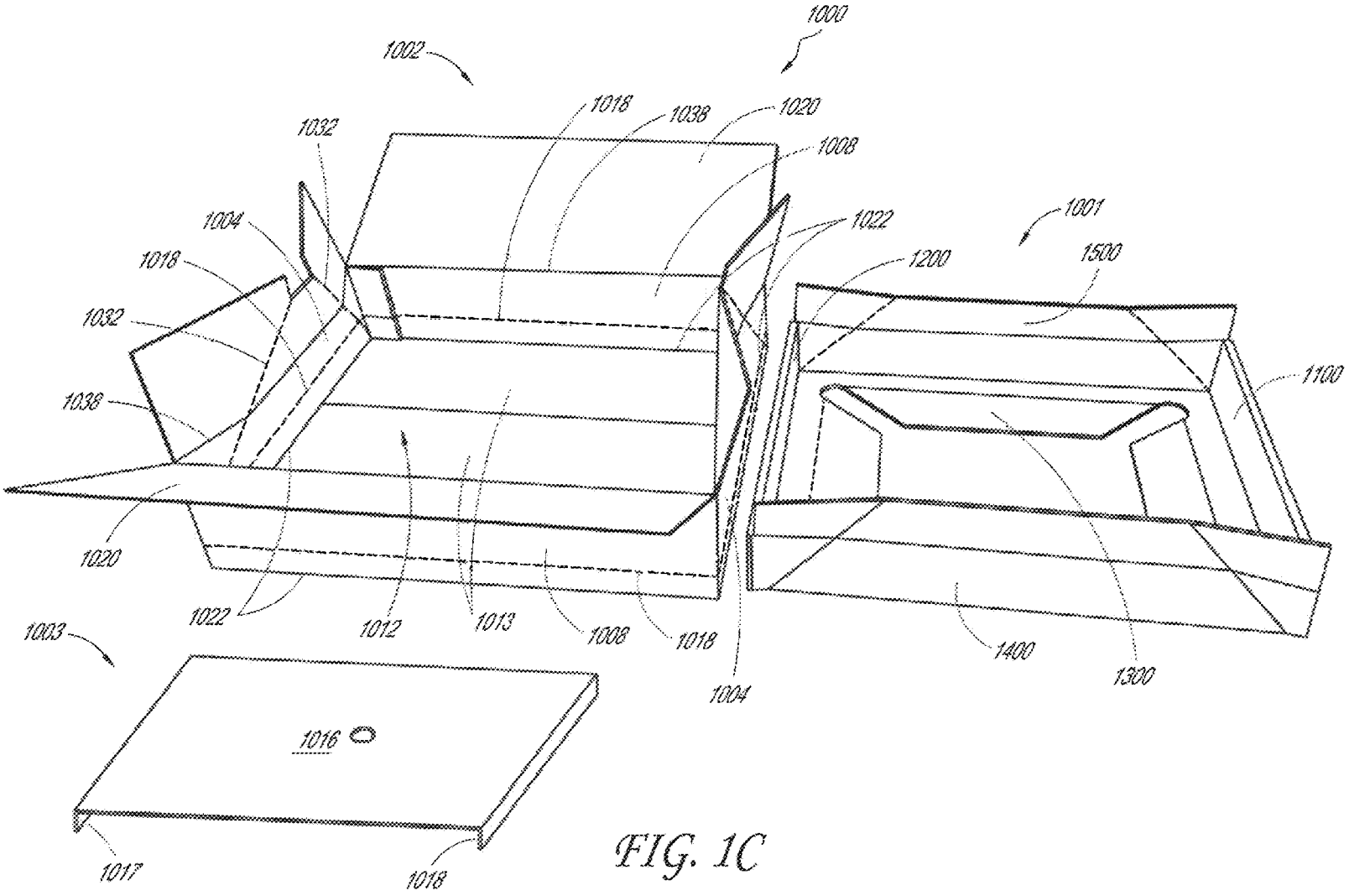
FIG. 1C is a perspective view of another embodiment of a packaging system comprising a contractible outer container in an expanded state and a collapsible shock absorbing frame and an optional support member.
Figure 2:
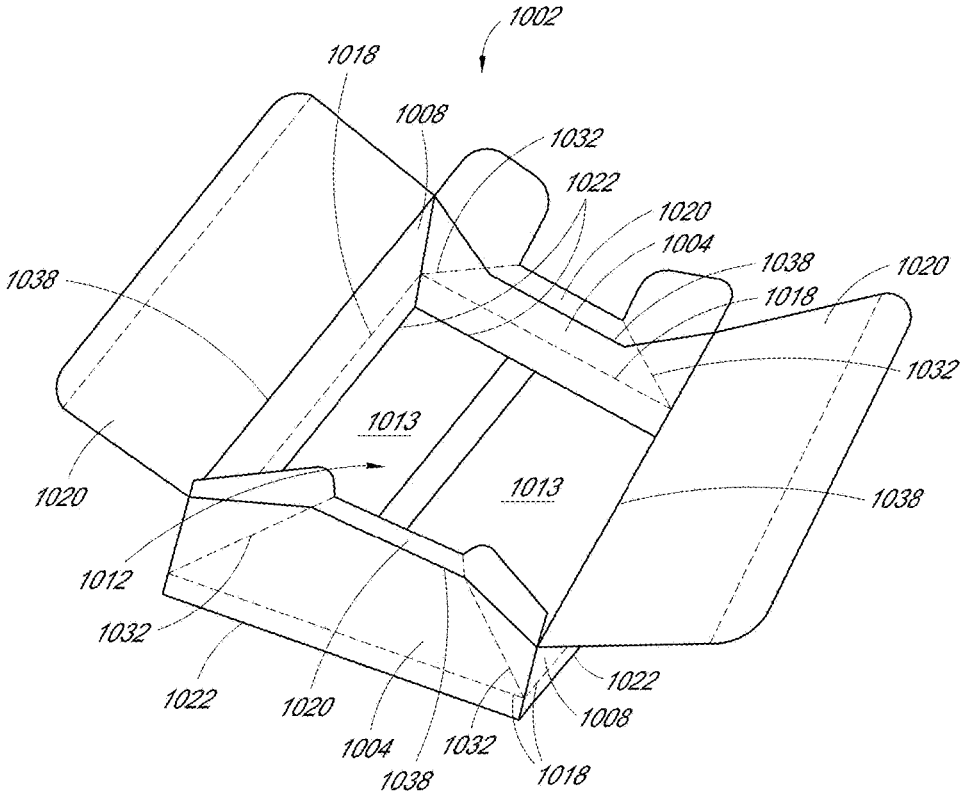
FIG. 2 is a perspective view of the outer container of FIG. 1C, in an intermediate step in the process of folding the outer container into a collapsed state.
Figure 3:
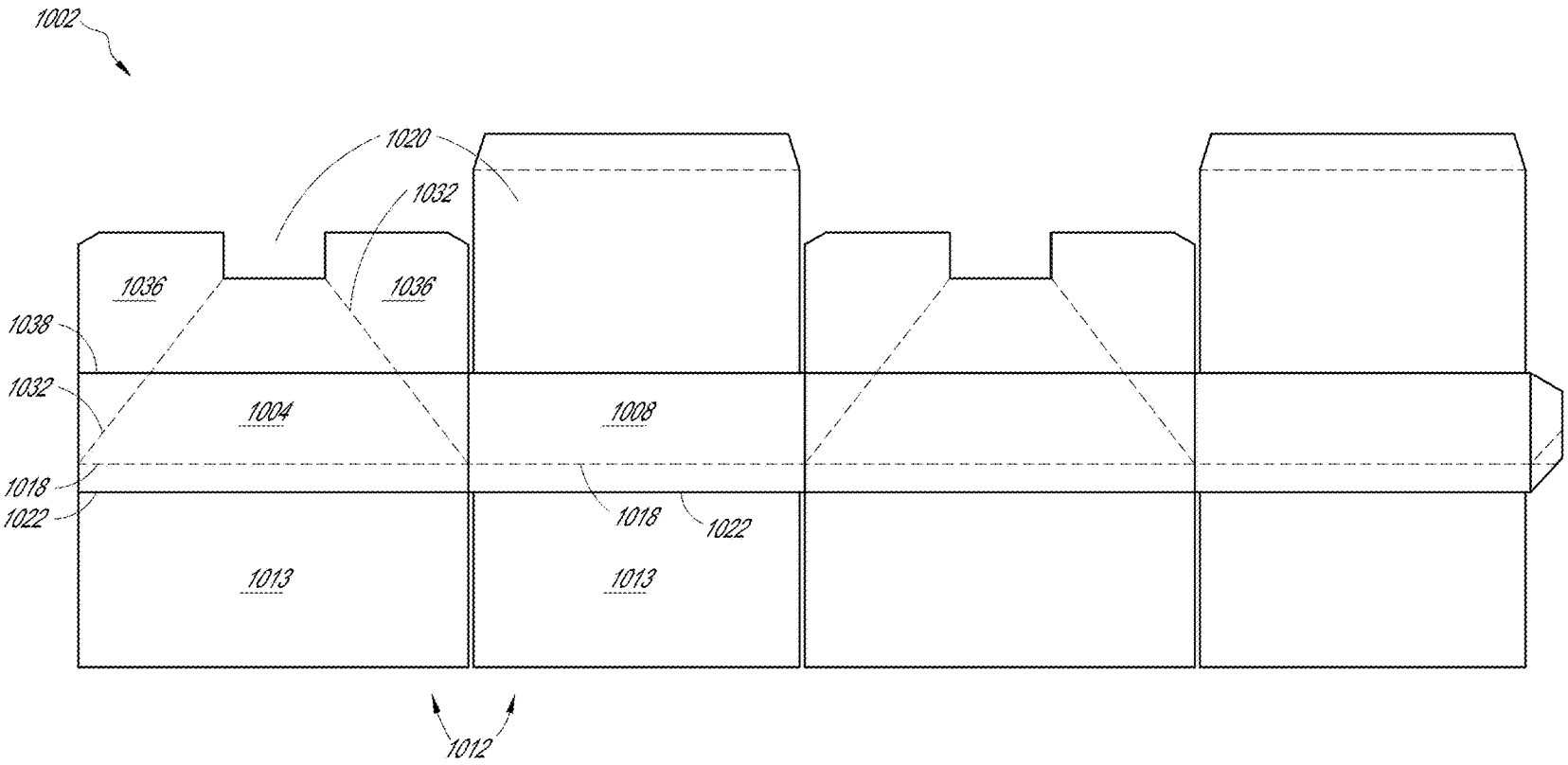
FIG. 3 is a schematic view of a cut sheet of corrugated cardboard that can be used to construct an embodiment of the outer container.

FIG. 1*c* illustrates a further variation of the systems 100, 200, identified generally by the reference numeral 1000. Parts, components, features, and advantages of the system 1000 which are the same or similar to corresponding parts, components, features, and advantages of the systems 100 or 200 are identified with similar reference numerals. Descriptions of the parts, components, features, and advantages of the systems 100 or 201 also applied to the corresponding parts, components, features, and advantages of the system 1000.

As illustrated in the subsequent figures and discussed further below, the return shipping system 1000 can include an outer container 1002 and a collapsible shock absorbing frame 1001. An article for shipping can be placed within the outer container 1002 and protected against damage during shipping by the collapsible shock absorbing frame 1001 and the outer container 1002.

The outer container 1002 can have a collapsed state and an expanded state. In both states, the outer container 1002 can be substantially enclosed on all sides and configured for shipping through conventional post services such as the United States Postal Office and UPS, etc. This enables the outer container to be sent through the post in the collapsed state at a reduced rate as compared to the cost of sending the outer container through the post when in the expanded state.

When in the expanded state, the outer container 1002 defines an interior volume sized to accommodate the article for shipping and the collapsible shock absorbing frame 1001 in a deployed configuration. When in the collapsed state, the outer container 1002 defines an interior volume sized to accommodate the collapsible shock absorbing frame 1001 in a collapsed configuration and not in the deployed configuration. Further details of the improved return shipping system 1000 are described below.

Outer Container

The outer container 1002 can be constructed in the manner described in U.S. application Ser. No. 14/086,894, filed on Nov. 21, 2013, the entire contents of which incorporated herein by reference.

The outer container 1002 can have both a collapsed state and an expanded state. In some embodiments, when in either of these two states, the outer container 1002 can be fully and securely enclosed, making it suitable for shipping through the conventional post such as the United States Postal Office and UPS, etc.

Referring to FIGS. 1C-3, in some embodiments of the outer container 1002, the outer container can comprise a plurality of side walls 1004, a plurality of end walls 1008, a bottom panel 1012, and a plurality of top or lid panels 1020. The side and end walls 1004, 1008 can be collapsed or folded inwardly towards the bottom 1012 to transition the outer container 1002 from the expanded state into the collapsed state. The side and end walls 1004, 1008 can be expanded or folded outwardly to transition the outer container 1002 from the collapsed state into the expanded state. The collapsed state defines a smaller reservoir volume and the expanded state defines a larger reservoir volume of the outer container.

The side walls 1004 and the end walls 1008 can each comprise a fold lines of a plurality of fold lines 1018 extending horizontally across the side walls 1004 and end walls 1008. In one embodiment of the outer container, the outer container is collapsed or folded inwardly along these fold lines 1018 in the side walls 1004 and the end walls 1008 to fold the outer container 1002 from the expanded state to the collapsed state. Alternatively, the side and end walls 1004, 1008 are folded along a plurality of bottom fold lines 1022 when folding between the expanded state and the collapsed state.

In some embodiments, such as illustrated in FIGS. 1C-3, the side walls 1004 can comprise diagonal fold lines 1032 defining wing portions 1036. As the outer container is collapsed or folded inwardly, the end walls 1008 and side walls 1004 fold along the fold lines 1018 (or bottom fold lines 1022) and the wing portions 1036 can fold along the corresponding diagonal fold lines 1032. This folding of the wing portions 1036 is illustrated in an intermediate stage in FIGS. 2 and 11 and in the complete state in FIGS. 12 and 13.

Figure 13:
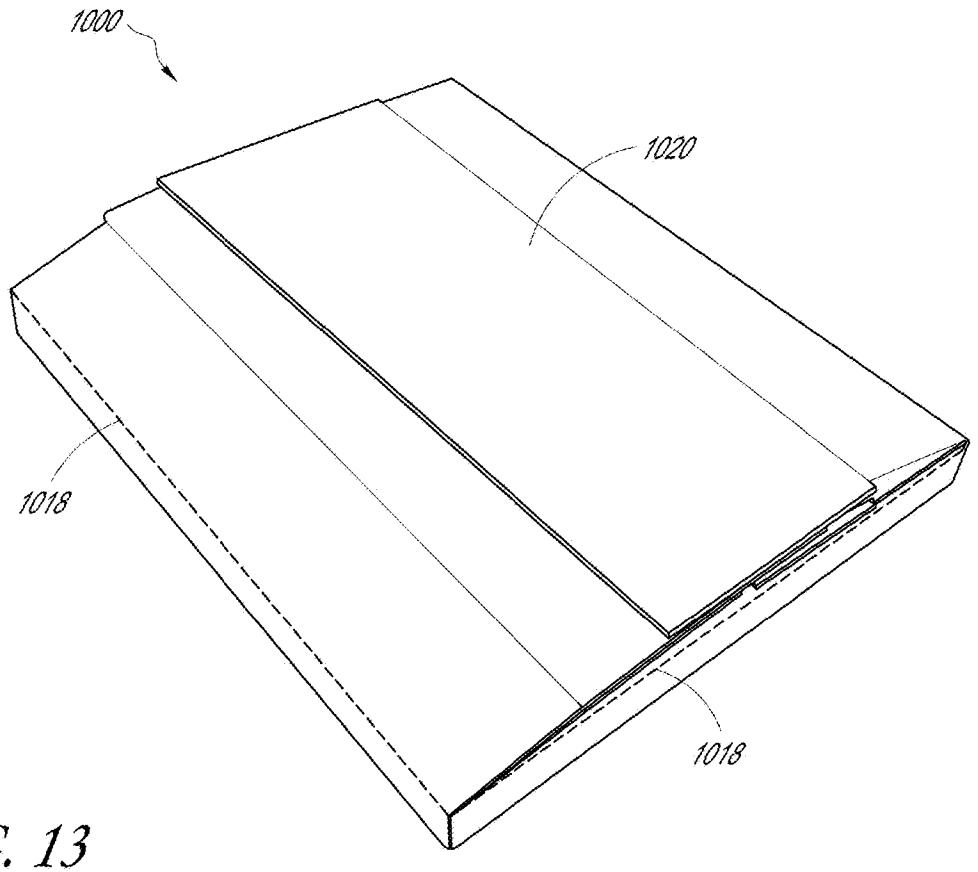
FIG. 13 is a perspective view of the outer container and the collapsible shock absorbing frame of FIG. 1 in a collapsed state.
Figure 15:
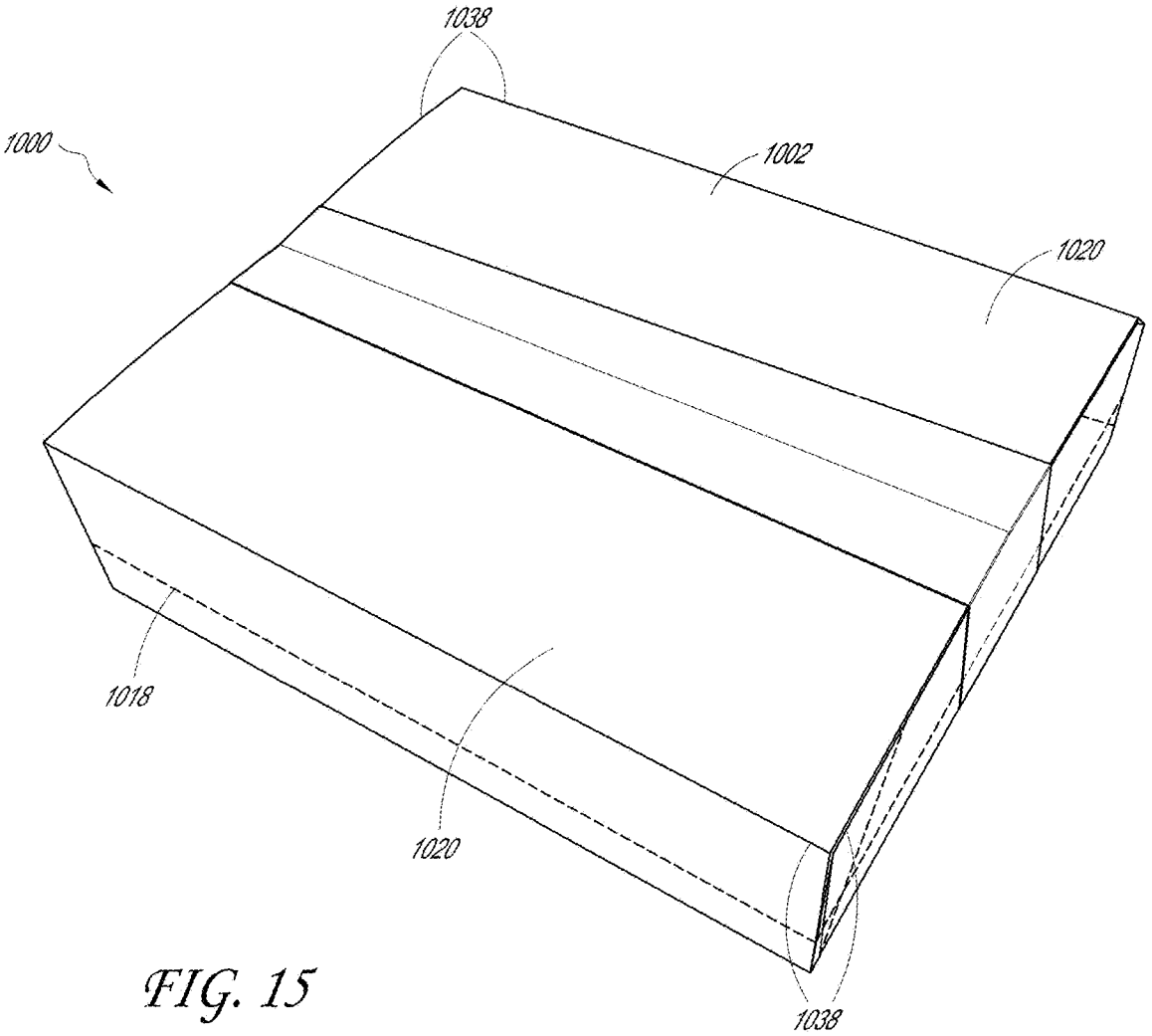
FIG. 15 is a perspective view of the outer container of FIG. 14 in an expanded state ready for shipping.

When folded into a shipping configuration when in the collapsed state, the plurality of top panels 1020 and the end walls 1008 can be folded along the plurality of fold line 1018 to fully enclose the smaller reservoir volume. FIG. 13 illustrates the outer container 1002 in a shipping configuration when in the collapsed state. When folded into a shipping configuration in the expanded state, the plurality of top panels 1020 can be folded with respect to the side and end walls 1004, 1008 along a plurality of top fold lines 1038 to fully enclose the larger reservoir volume. FIG. 15 illustrates the outer container 1002 in a shipping configuration when in the expanded state.

In some embodiments of the packaging system 1000, the bottom 1012 of the outer container 1002 can further comprise a removable bottom support member 1003. The removable bottom support member 1003 can comprise a central panel 1016 and first and second leg panels 1017 and 1018. In some embodiments, the removable bottom support member 1003 can be placed within the outer container 1002, a user can place an article for shipping on top of the removable bottom support member 1003 and the collapsible shock absorbing frame 1001 can be placed on top of the article for shipping. In such embodiments, the removable bottom support member 1003 provides additional cushioning and stability to the article 103 for shipping. For example, the first and second leg portions 1017, 1018 can provide some resilience against shock and the central panel 1016 in itself flexed may provide additional shock absorbed shipping of the article 103.

In some embodiments, the removable bottom support member 1003 can be in the form of a raised platform for the collapsible shock absorbing frame 1001. In such an embodiment, the raised platform can be used to position the collapsible shock absorbing frame 1001 within the outer container 1002. For example, the collapsible shock absorbing frame can be positioned above the bottom support member 1003 such that the collapsible shock absorbing frame 1001 must be folded into a collapsed state when the outer container is folded into the collapsed state and/or the outer frame cannot be folded into the collapsed state when the collapsible shock absorbing frame 1001 is in the deployed configuration.

Collapsible Shock Absorbing Frame

The collapsible shock absorbing frame 1001 can comprise end walls 1100 and 1200 and side walls 1400, 1500, and bottom panel 1300. The collapsible shock absorbing frame 1001 has a collapsed state in which the side walls 1400, 1500 are folded or collapsed inwardly with respect to the bottom panel 1300 along bottom fold lines 1304 and 1306. The end walls 1100, 1200 can also be folded in with respect to the bottom panel 1300 along bottom fold lines 1308 and 1310 in the collapsed state.

Figure 4:
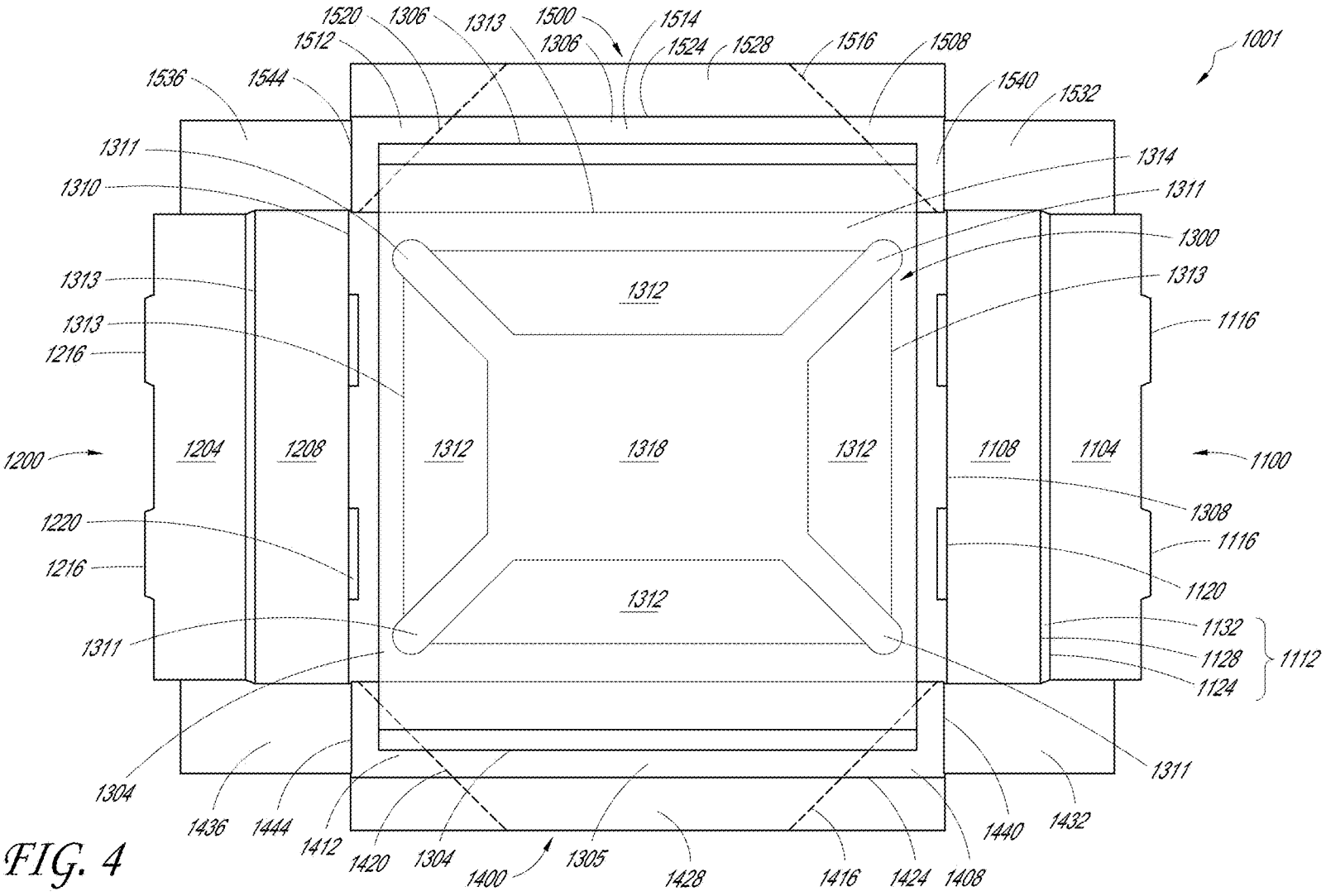
FIG. 4 is a schematic view of a cut sheet of corrugated cardboard that can be used to construct an embodiment of a collapsible shock absorbing frame.

Referring to FIG. 4, in some embodiments, the collapsible shock absorbing frame 1001 can be made of a cut and folded sheet of corrugated cardboard, or other materials. In such embodiments, the bottom fold lines 1304-1310 can provide some resistance to folding wherein when the end walls 1100 and 1200 are folded towards the bottom panel 1300. Similarly with the side walls 1400 and 1500 being folded in along the bottom folds towards the bottom panel 1300 the material of the collapsible shock absorbing frame can provide some resistance due to folding. This resistance can stem from placing the material of the collapsible shock absorbing frame 1001 into compression, such as at the bottom fold lines 1304-1310. Thus in some embodiments of the collapsed state of the collapsible shock absorbing frame 1001, the material of the collapsible shock absorbing frame can provide a force tending to unfold the end walls 1100 and 1200 and the side walls 1400 and 1500 into an deployed state.

FIG. 4 illustrates an embodiment of the collapsible shock absorbing frame 1001 formed from a cut sheet of corrugated cardboard, in a flat, unfolded state. The collapsible shock absorbing frame 1001 can be made out of a single sheet of cardboard divided into various panels with a plurality of cuts and fold lines. In other embodiments of the collapsible shock absorbing frame 1001, the collapsible shock absorbing frame comprises multiple different sheets of material such as cardboard and is assembled from those multiple different sheets to form the embodiment of the collapsible shock absorbing frame 1001.

The collapsible shock absorbing frame 1001 comprises a bottom panel 1300. The bottom panel 1300 can include a central portion 1314. Alternatively, in some embodiments, the central portion 1314 can include a central aperture 1318 such as illustrated in FIG. 4. In some embodiments, a plurality of bottom flaps 1312 can be configured around the central aperture 1318. In some embodiments, these extend towards a center of the central aperture 1318. The flaps 1312 can either be non-foldable or in some embodiments, include a fold line 1313 wherein the flap 1312 is attached to the inside edge of the central aperture 1318 of the bottom panel 1300. These flaps 1312 can be configured to retain an article against them, such as during shipping. The article can deflect flaps 1312 and the flaps can provide some resistance thereby prevent movement of the article when in the assembled state of the collapsible shock absorbing frame 1001. In some embodiments the flaps 1312 can be divided by one or more spaces or cuts 1311.

With reference to FIGS. 34 and 35, in some embodiments, collapsible shock absorbing frame 1001 can include a resilient sheet 1304 attached thereto, which can be in the form of any of the variations of the resilient sheet 204 described above. The resilient sheet 1304 can have first and second ends 1305, 1306 that are attached to either portions of the bottom panel 1300 such as the central panel 1314 or alternatively they can be attached to either of the end walls 1100, 1200 or side walls 1400, 1500. Although the resilient sheet 1304 is omitted from FIGS. 36-38 and 40-42, and 44, it is to be understood that the resilient sheet 1304 remains attached to the collapsible shock absorbing frame 1001 in all of the movements and configurations illustrated and described with reference to FIGS. 31 and 34-45.

The resilient sheets 1304 can provide stability for an article for shipping when placed against the collapsible shock absorbing frame 1001. For example, in some embodiments, the resiliency of retention sheet 1304 can be pliable and/or have a 'stickiness' to it, such that the article is retained in place when contacted with the resilient sheet 1304. In some embodiments, the resilient sheet 1304 is used across the central aperture 1318 and/or across the flaps 1312. The resilient sheets 1304 can be attached with any known technique including staples, adhesives, pockets, etc. In some embodiments, the resilient sheet 1304 is heat sealed to the material of the collapsible shock absorbing frame 1002 using the methods described in US Pat. Publ. No. 2015/0266642, the entirety of which is incorporated herein by reference. In some embodiments, the attachment of the first and second ends 1305 and 1306 with the end walls 1100, 1200 or side walls 1400, 1500 can be made such that any tension across the resilient member 1305 created when used for packaging an article 103 are withstood. Such tension can be from placing the frame 1001 in contact with an article 103 for shipping or folding of the end walls 1100, 1200 or side walls 1400, 1500 and/or the locking portion 1428.

The collapsible shock absorbing frame can include side walls 1400 and 1500. The side wall 1400 can be attached with the bottom panel 1300 at a bottom fold line 1304 such that the side wall 1400 can be pivotably connected with the bottom panel 1300. The side wall 1400 can comprise a central portion 1404 and two triangular portions 1408 and 1412. Each of the triangular portions 1408, 1412 can be connected with the central portion 1414 along diagonal fold lines 1416, 1420, respectively. The side wall 1400 can further comprise a locking fold line 1424. In some embodiments, the locking fold line 1424 extends across the central panel 1404 and either or both of the triangular panels 1408 and 1412.

The locking fold line 1424 can at least partially define a locking portion 1428 of the side wall 1400. In some embodiments, the locking portion 1428 being at the peripheral edge of the side wall 1400 and extending outwardly from the locking fold line 1424. The locking fold line 1424 can extend across the side wall 1400 in a direction parallel to the bottom fold line 1304. In some embodiments, the locking fold line 1424 intersects one or both of the diagonal fold lines 1416, 1420. This intersection can in some embodiments be at a 45° angle. In some embodiments, the locking portion 1428 comprises segments of the central portion 1404 and portions of the triangular panels 1408, 1412 of the side wall 1400. The locking portion 1428, when folded along the locking fold line 1424, can act as a stiffener to the side wall 1400 and thereby providing additional stability to the shock absorbing frame.

All of the folds of fold lines discussed here can be pre-formed into the panels using a variety of techniques. For example, where the panels are formed of cardboard, fold lines can be formed in the cardboard by crushing together the inner and outer layers of the cardboard along straight lines. In other examples, the fold lines can comprise a plurality of slits of perforations in the outer layer of cardboard along straight lines. A biasing of the fold lines can be introduced by treating the outer layers on opposite sides of a cardboard panel differently. For example, providing a slit or a plurality of perforations on one layer of cardboard but not the other biases the fold line to fold in the direction opposite the slit. In another embodiment, a slit is made on one layer while the opposite layers is crushed.

While all fold lines discussed herein can be made using any of the above techniques, it can be advantageous to pre-form the locking fold lines 1425, 1524 and/or the diagonal fold lines 1416, 1420, 1520, 1516. These fold lines can also be made with the biasing fold line techniques. For example, the locking fold lines 1425, 1524 can be biased to fold inwardly into the locking configuration and/or the diagonal fold lines 1416, 1420, 1520, 1516 can be biased to fold outwardly such that the triangular portions 1408, 1412 overlap the central portions 1404, 1504.

One or both of the diagonal fold lines 1416 or 1420 can intersect with the bottom fold line 1304. This intersection can in some embodiments be at a 45° angle. In some embodiments, the intersection of the one or both diagonal fold lines 1416, 1420 with the bottom fold line 1304 can be at one of the corners 1453, 1454, respectively, of the collapsible shock absorbing frame 1001.

In some embodiments, the side wall 1400 can comprise side flaps 1432, 1436. The side flaps 1432, 1436 can be pivotably coupled with the side wall 1400 and in some embodiments with the triangular portions 1408, 1412 along flap fold lines 1440 and 1444, respectively. In some embodiments, the one or both diagonal fold lines 1416, 1420 can intersect with the flap fold lines 1444, 1440, respectively. This intersection can in some embodiments be at a 45° angle. In some embodiments, the one or both diagonal fold lines 1416, 1420 can intersect with the flap fold lines 1444, 1440, respectively and the bottom fold line 1304 at the corner 1452 of the collapsible shock absorbing frame 1001.

In some embodiments of the collapsible shock absorbing frame 1001, the structure of the side wall 1500 reflects the same structure as the side wall 1400. In FIG. 4, the callouts of the side wall 1500 correspond to the features of the side wall 1400 with the numbering reflecting the 15xx corresponding to the side wall 1500. In other embodiments, the side wall 1500 can have a different structure.

End wall 1100 of the collapsible shock absorbing frame 1001 can comprise an inner panel 1104 and an outer panel 1108, the inner panel 1104 being pivotably coupled with the outer panel 1108 along a ridge fold line 1112. The outer portion 1108 can be pivotably coupled with the bottom panel 1300 at the bottom fold line 1304. In some embodiments, the ridge fold line 1112 can comprise a plurality of fold lines 1124 and 1128. The ridge fold line 1112 can further comprise a ridge panel 1132 between the fold 1124 and 1128 of the ridge fold line 1112.

The inner panel 1104 can comprise one or more tabs 1116 extending, in some embodiments, peripherally outward from the ridge fold line 1112. In some embodiments, either the bottom panel 1300 or a portion of the outer panel 1108 adjacent to the bottom fold line 1304 can comprise one or a plurality of recesses 1120 corresponding to the tabs 1116.

In some embodiments of the collapsible shock absorbing frame 1001, the end wall 1200 can comprise the same structures and features of the end wall 1100 and the end wall 1100 callouts in FIG. 4 correspond accordingly with the 12xx numbering of the end wall 1200. In other embodiments, the end wall 1200 can have a different structure.

Figure 5:
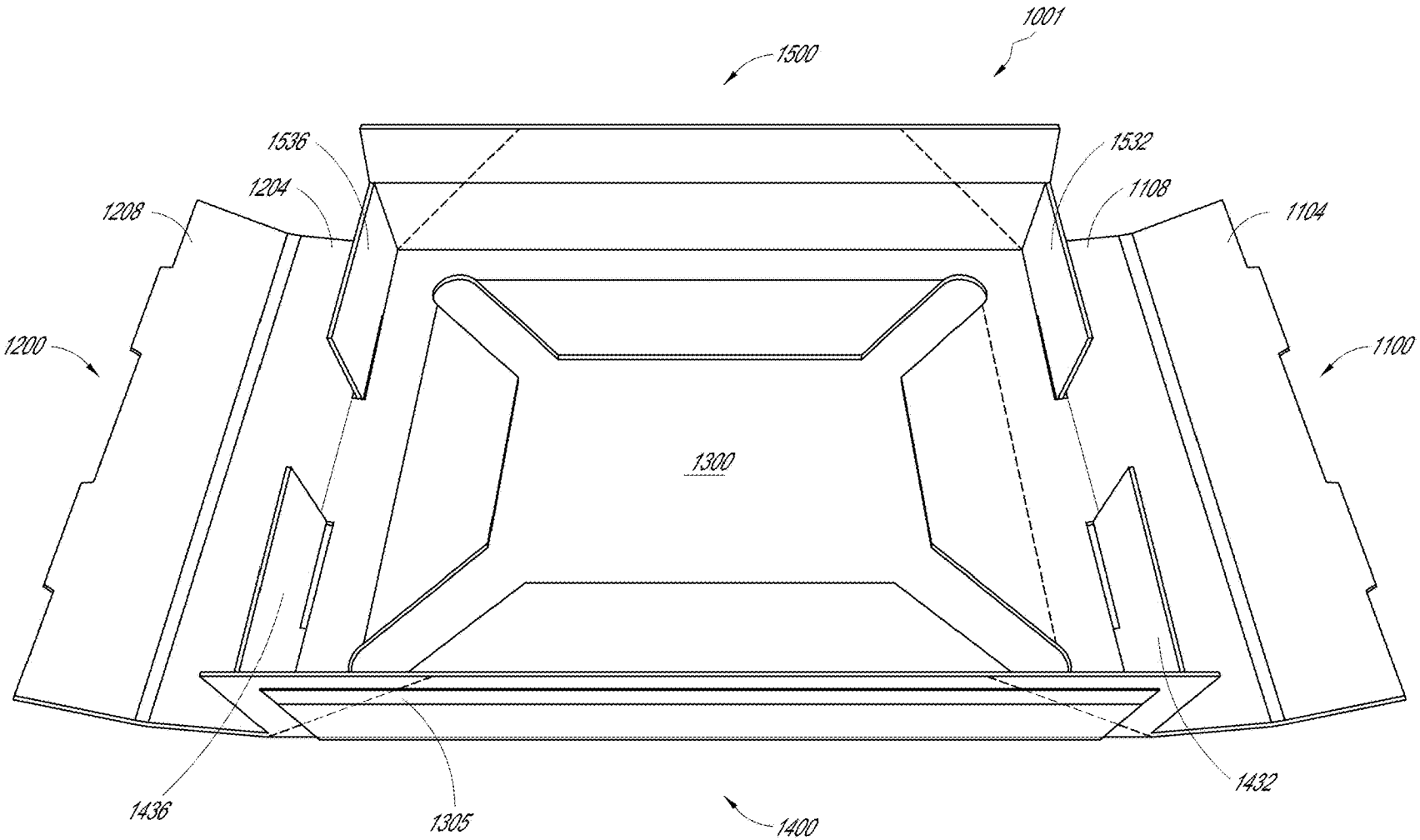
FIG. 5 is a perspective view of the collapsible shock absorbing frame of FIG. 4 in a partially assembled state and with a resilient sheet attached.

FIG. 5 illustrates the collapsible shock absorbing frame 1001 in a partially assembled state with the side walls 1400 and 1500 pivoted along bottom fold lines 1304. As illustrated, the side walls 1400 and 1500 are at a right angle with the bottom panel 1300. Furthermore, the side flaps 1432 and 1436 have been pivoted along the side flap fold lines 1440, 1444 and can rest on the bottom panel 1300 or the end walls 1100, 1200. The side flaps 1432 and 1436 can thus provide some stability to the collapsible shock absorbing frame 1001 when assembled.

Figure 6:
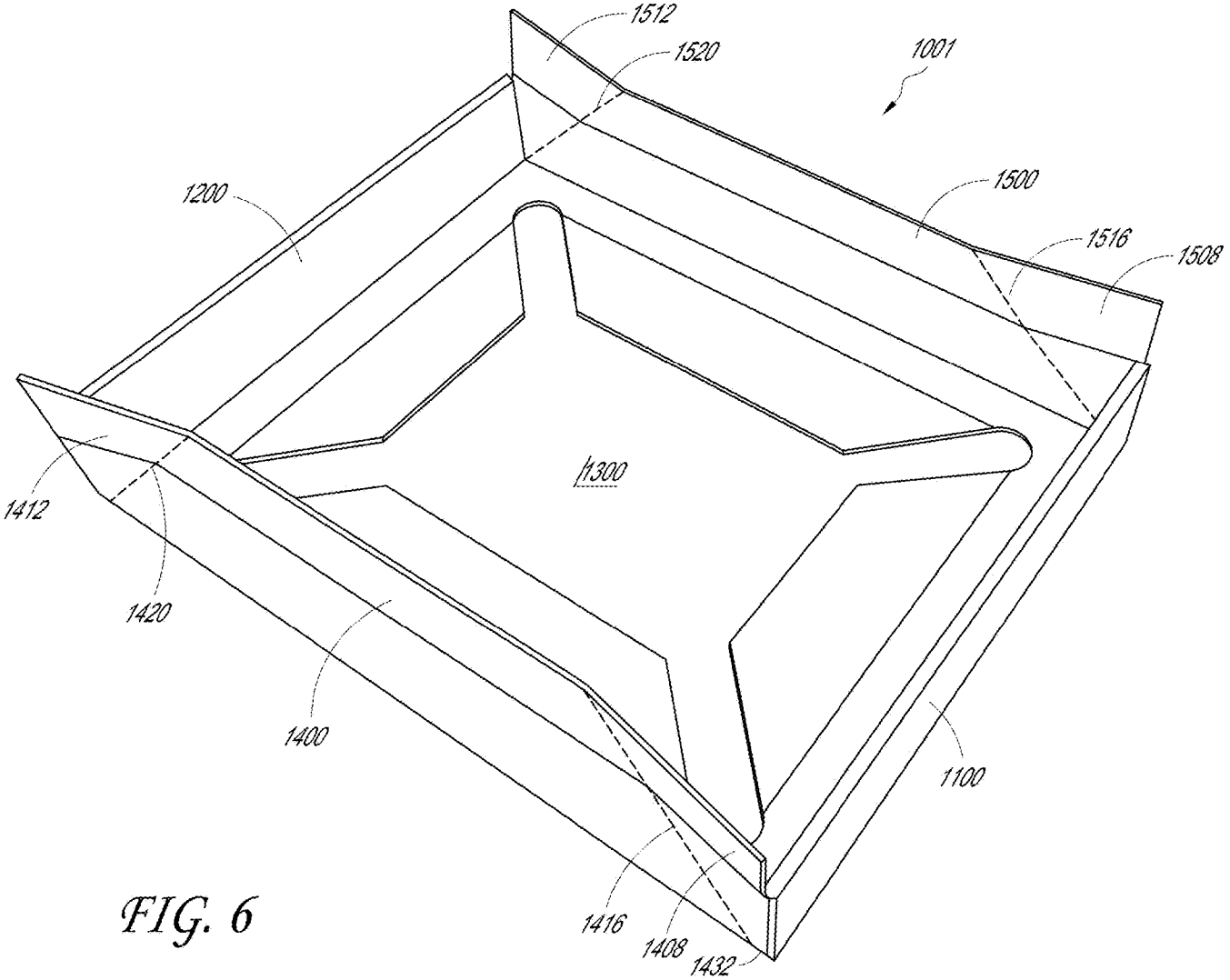
FIG. 6 is a perspective view of the collapsible shock absorbing frame of FIG. 4 in a deployed state, with the resilient sheet removed.

For example, as illustrated further in FIG. 6, the end walls 1100 and 1200 can be folded over the side flaps 1432, 1436 and 1532 and 1536 to hold the side walls 1400 and 1500 in place when in the assembled state. For example, the outer panel 1108 of the side wall 1100 can be folded up along the bottom fold line 1304 such that the outer panel 1108 is parallel or substantially parallel with the side flap 1432 and the inner panel 1104 can be folded along the ridge fold line 1112 and be folded against an inner side of the side flap 1432. Thus the end wall 1100 can retain the side wall 1400 in place when the collapsible shock absorbing frame is in an assembled state. In some embodiments, the tab 1116 can be placed within the recess 1120 providing further structural integrity to the assembled state of the collapsible shock absorbing frame 1001.

In some embodiments, the outer panel 1108 can have a height that corresponds to a height of the side flap 1432. The ridge fold and/or the ridge panel 1132 can be aligned with or at the top portion 1448 of the side flap 1432. Similarly, the inner panel 1104 of the end wall 1100 can have a height that corresponds with the outer panel 1108 such that outer extension of the inner panel 1104 can meet with the bottom panel 1300 with one or both of the inner and outer panels 1104, 1008, substantially parallel with the side flap 1432 In some embodiments, the ridge panel 1132 can provide additional space between the inner panel 1104 and the outer panel 1108 such that the side flap 1432 can fit between the inner and outer panels, 1104, 1108.

In some embodiments, the locking fold line 1424 can also be aligned with the top portion 1448 of the side flap 1432. In some embodiments, the locking panel 1424 can be aligned with the ridge fold line 1112 and/or the ridge panel 1132. In such an embodiment, the locked configuration of the collapsible shock absorbing frame 1001 (discussed below) can have a height that extends only up to or at the top portion 1148, the ridge fold line 1112 and/or the ridge panel 1132.

FIG. 6 illustrates both end panels 1100 and 1200 having been folded in over the side flaps 1432 and 1436 and 1532 and 1536 and the tabs 1116 having been inserted into the recesses 1120, as described above. In some embodiments, as an alternative to using the side flaps 1432 and 1436, the end wall 1100 can be attached to the side wall 1400 at the corner 1452 by, for example, a tape or staple. Additionally, as an alternative to tabs 1116 and recesses 1120, the inner panel 1104 or the outer panel 1108 can be glued or otherwise mechanically engaged with the side flap 1432 or the bottom 1300.

Figure 7:
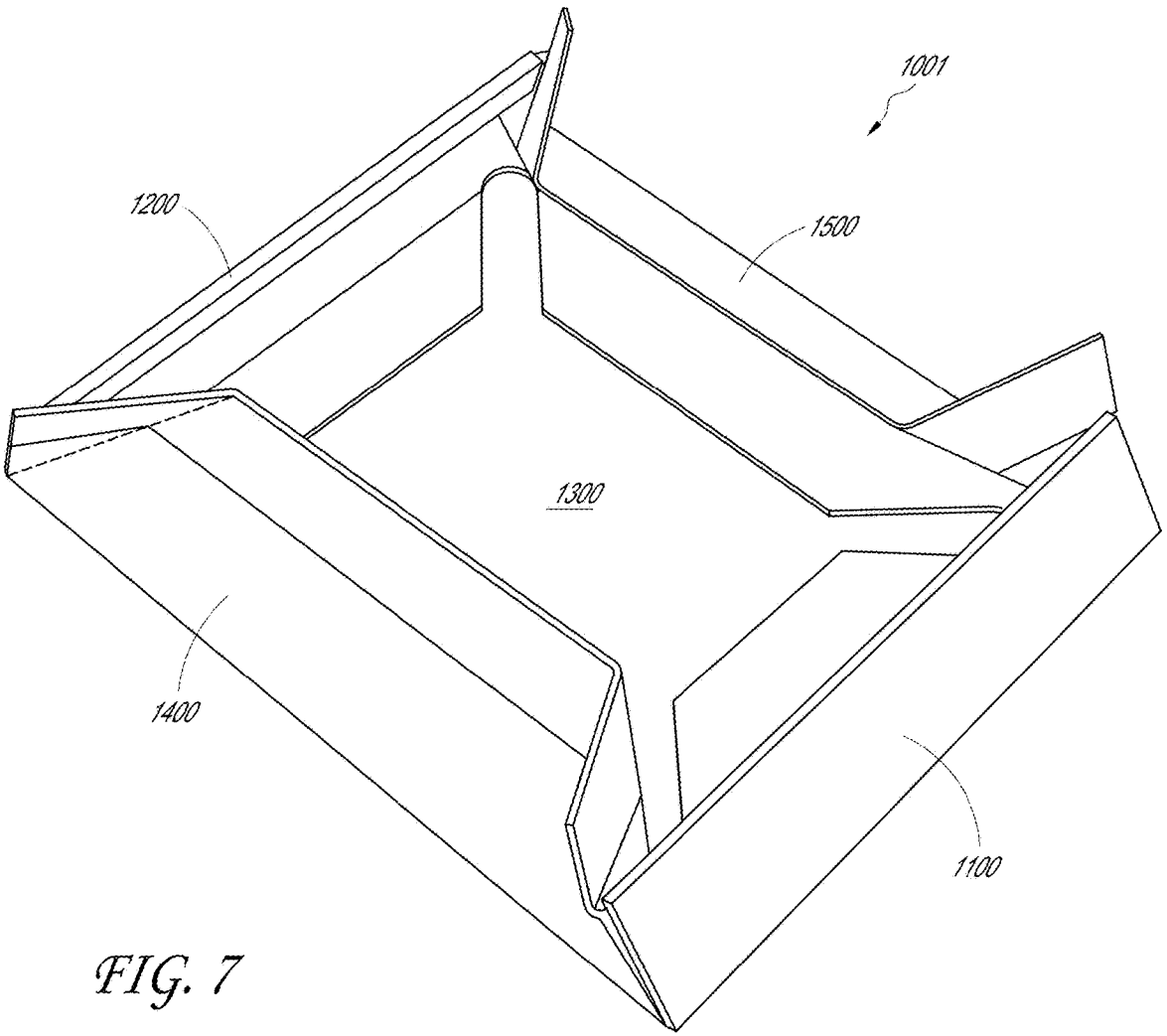
FIG. 7 is a perspective view of the collapsible shock absorbing frame of FIG. 4 in a partially collapsed state.
Figure 8:
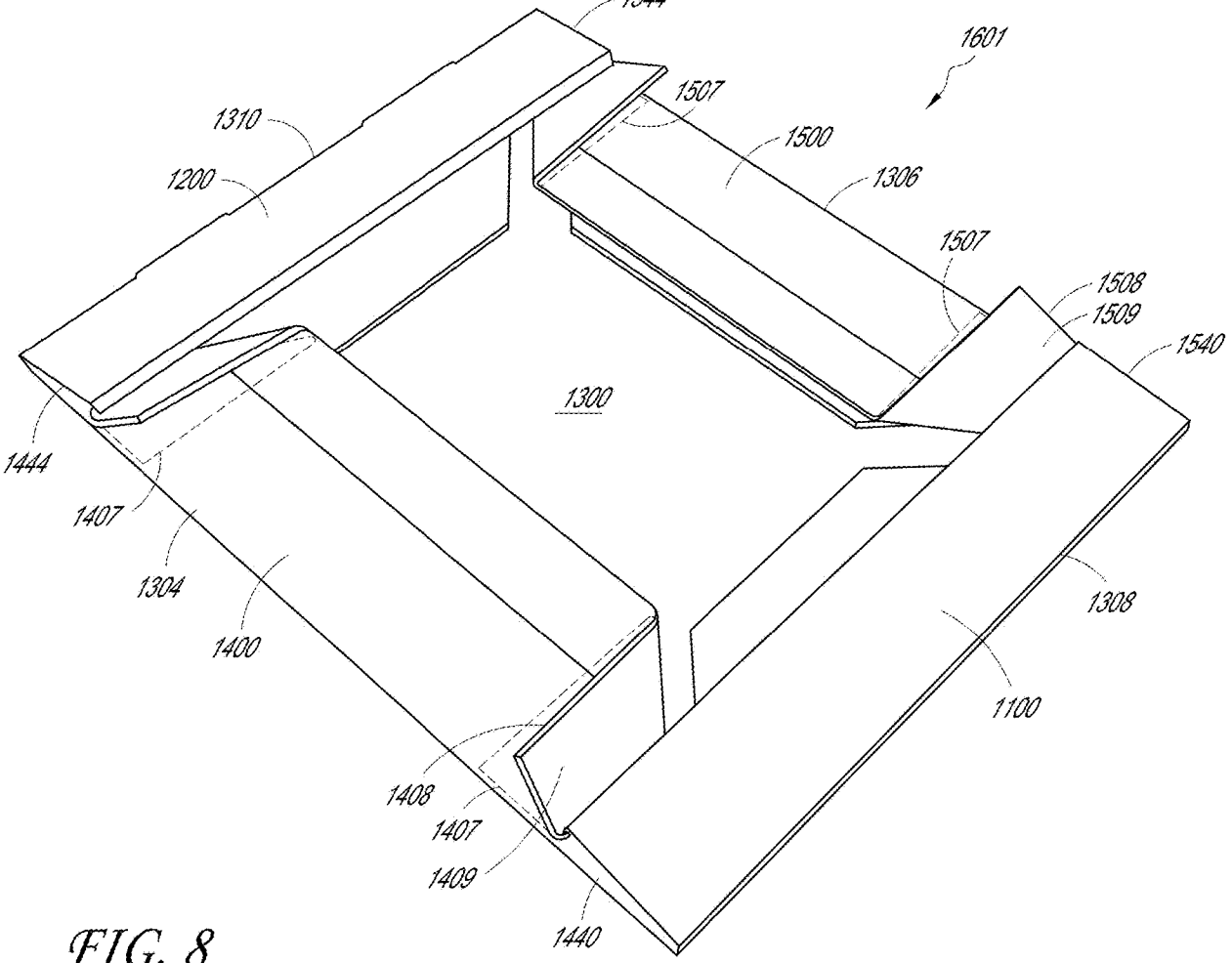
FIG. 8 is a perspective view of the collapsible shock absorbing frame of FIG. 5 in a collapsed state.
Figure 11:
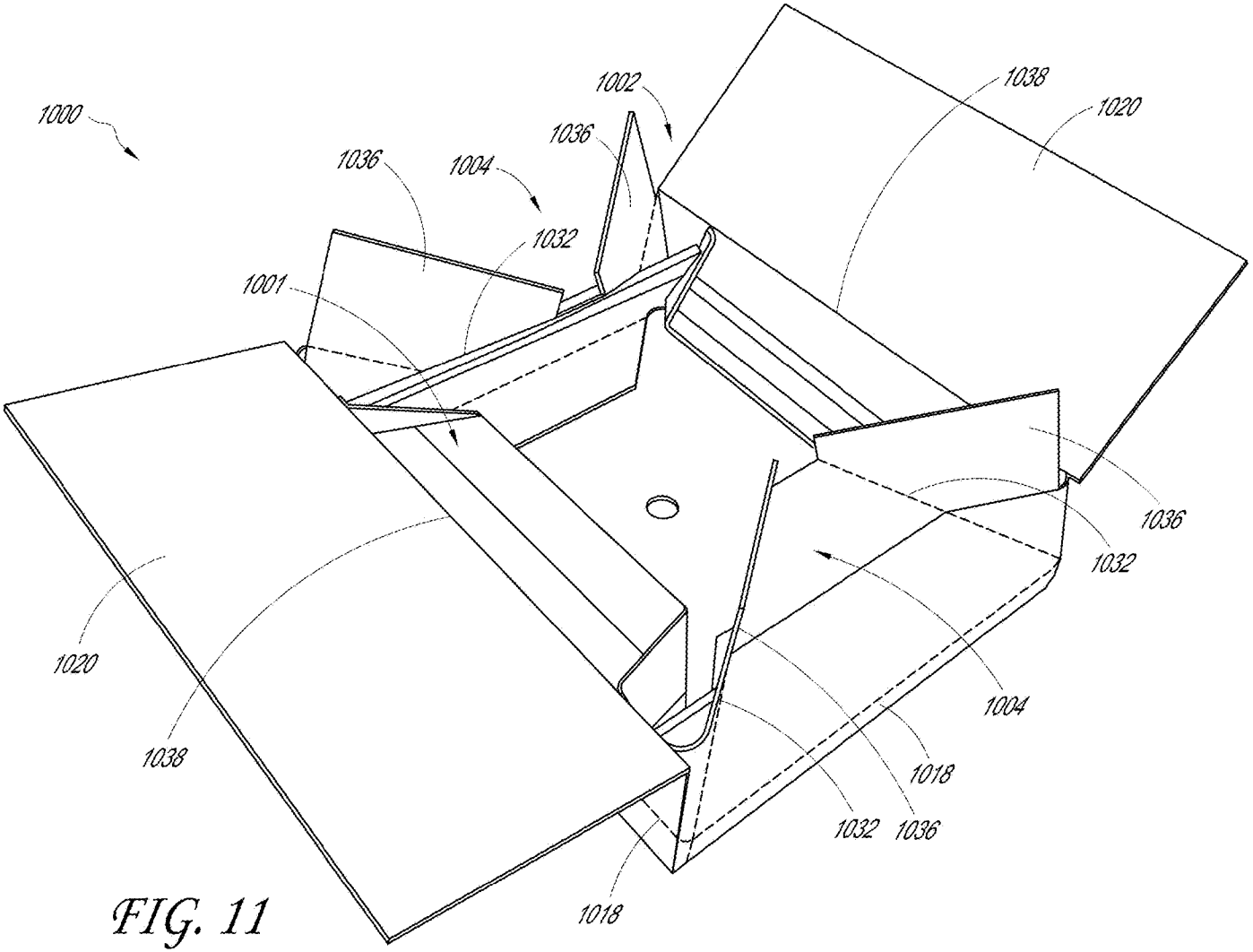
FIG. 11 is a perspective view of the collapsible shock absorbing frame nested within the outer container of FIG. 1 in a partially folded state.
Figure 12:
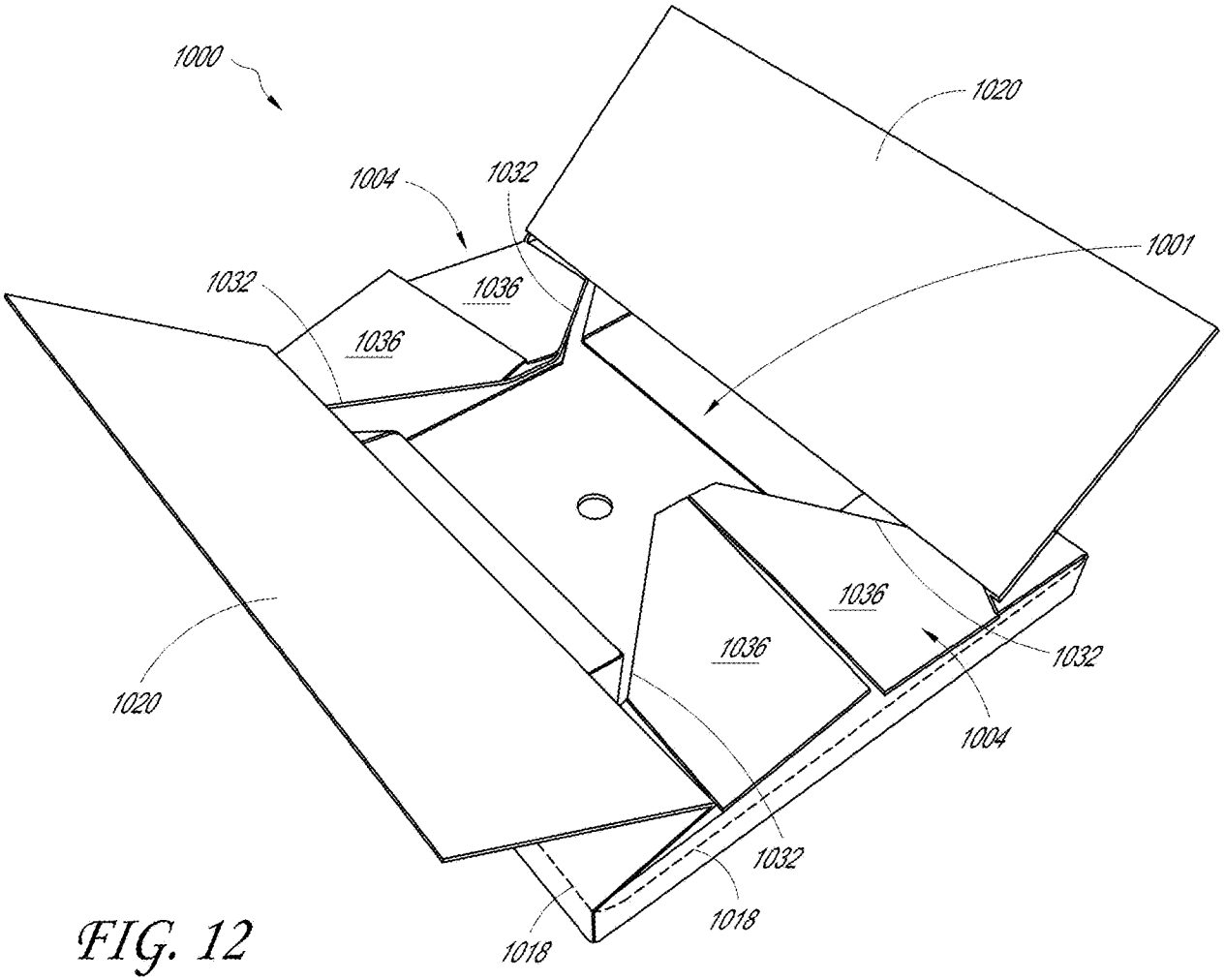
FIG. 12 is a perspective view of the collapsible shock absorbing frame nested within the outer container of FIG. 1 in a partially folded state.

FIG. 6 illustrates the collapsible shock absorbing frame 1001 in a deployed state and FIG. 7 illustrates the collapsible shock absorbing frame 1001 in a partially collapsed state. FIG. 8 illustrates the collapsible shock absorbing frame in the collapsed state. In some embodiments of the collapsed state, the end walls 1100 and 1200 are folded along of the bottom fold lines 1304 towards the bottom 1300. The side walls 1400 and 1500 can similarly be folded down towards the bottom panel 1300. In some embodiments, just the central portion 1404 of the side wall 1400 is folded down towards the bottom panel with the triangular panels 1408 and 1412 being folded outward or folded towards the side of end walls 1100 and 1200 such as is illustrated in FIGS. 11, 12. In some embodiments, the central portion 1404 can be folded along the bottom fold line 1304 and triangular panels 1408, 1412 can be folded along the diagonal fold lines 1444, 1440, respectively.

In some embodiments of the collapsible shock absorbing frame 1001 in the collapsed state, an surface 1409 of the triangular portion 1408 (and corresponding surfaces of triangular portions 1412, 1508, and 1512) can be turned outward and/or turned towards the end wall 1100 (or corresponding end wall 1200). In some embodiments the surface 1409 can contact the inner panel 1104 when in the collapsed state.

Figure 9:
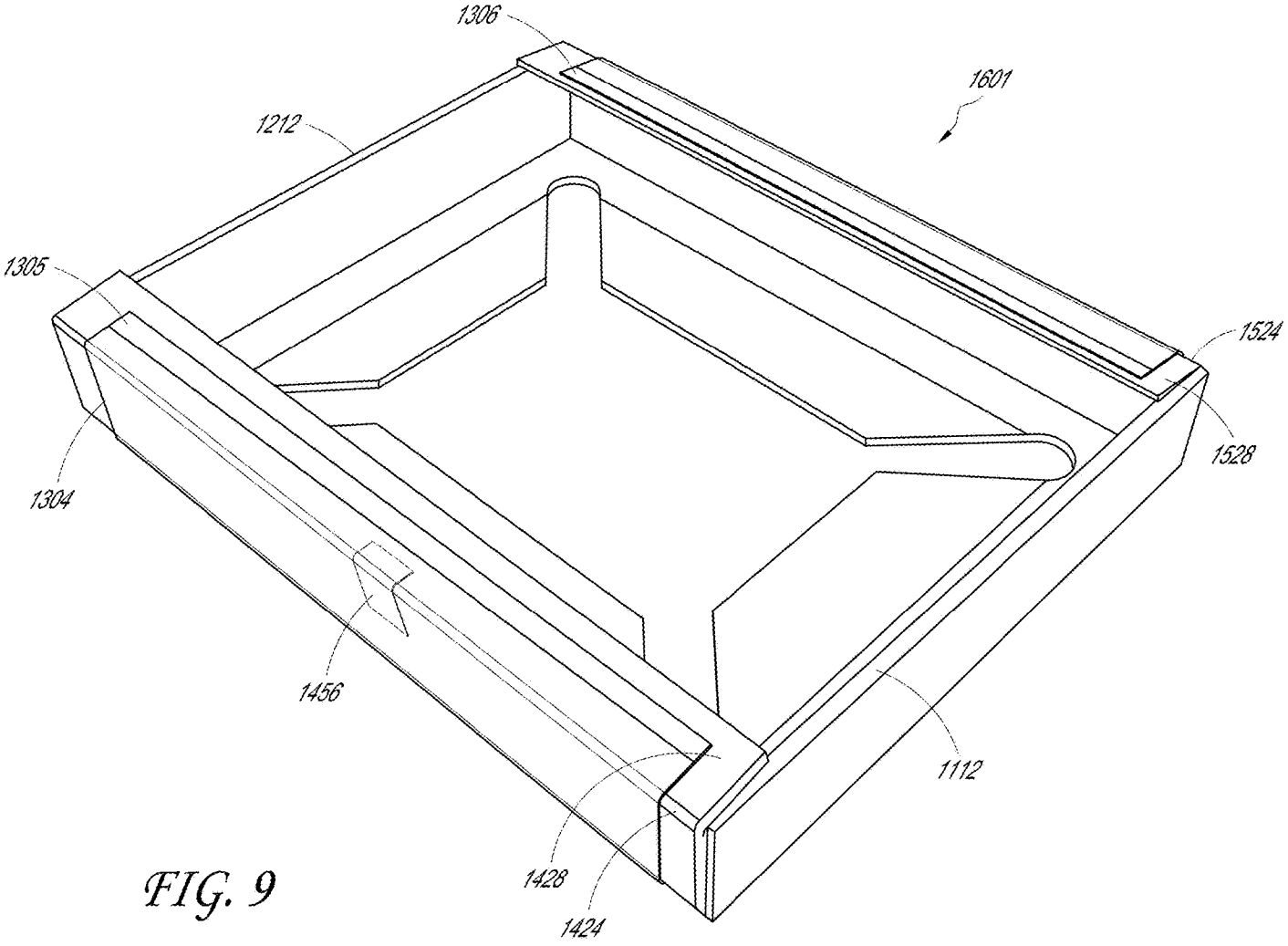
FIG. 9 is a perspective view of the collapsible shock absorbing frame of FIG. 4 in a deployed configuration with the resilient sheet attached.

FIG. 9 illustrates the collapsible shock absorbing frame 1001 in the deployed configuration with the locking portion 1428 folded with respect to the side wall 1400 along the locking fold line 1424. This forms a variant of the deployed configuration called the locking configuration. In this locked configuration, the collapsible shock absorbing frame cannot be moved into the collapsed state without unfolding the locking portion 1428 along the locking fold line 1424.

In some embodiments, the locking portion 1428 cannot be folded into the locked configuration along the locking fold line 1424 when the collapsible shock absorbing frame 1001 is in the collapsed state. This can be because the locking fold line 1424 extends across the central portion 1404 and one or both of the triangular portions 1416, 1420. Thus, when the collapsible shock absorbing frame is in the collapsed state with the triangular portions folded along the diagonal fold lines, 1444, 1440, respectively, the locking fold line 1424 does not form a straight line that is capable of being folded. In some embodiments, this configuration of the locking fold line 1424 can define when the collapsible shock absorbing frame is in the collapsed state. Alternatively, the collapsed state is defined by any of the side walls 1400, 1500 and/or end walls 1100, 1200 are folded inwardly towards the bottom 1300.

In some embodiments, the locking fold line 1424 aligns with the top ridge fold 1112 of the end wall 1100. In other embodiments, the locking panel and the locking fold line are above or below the ridge line 1112. In some embodiments, the locking portions 1428, 1528 can have a length such that they overlap each other when in the locked configuration.

In some embodiments, the resilient sheet 1304 can be have one end portion 1305 attached to the locking portion 1428 and/or the second end portion 1306 attached with the locking portion 1528. In such an embodiment, the folding of the locking portions 1428, 1528 can thus apply a tension to the resilient sheet 1304.

In some embodiments of the collapsible shock absorbing frame 1001, the side wall 1400 can comprise a locking tab to maintain the collapsible shock absorbing frame in a locked configuration. For example, the side wall 1400 can include a locking tab 1456 defined by a plurality of slits 1460, the plurality of slits going through the locking fold line 1424 onto both of the locking portion 1428 and the central portion 1404. The tab 1456 can be folded inwards to help maintain the collapsible shock absorbing frame within the locked configuration.

Figure 10:
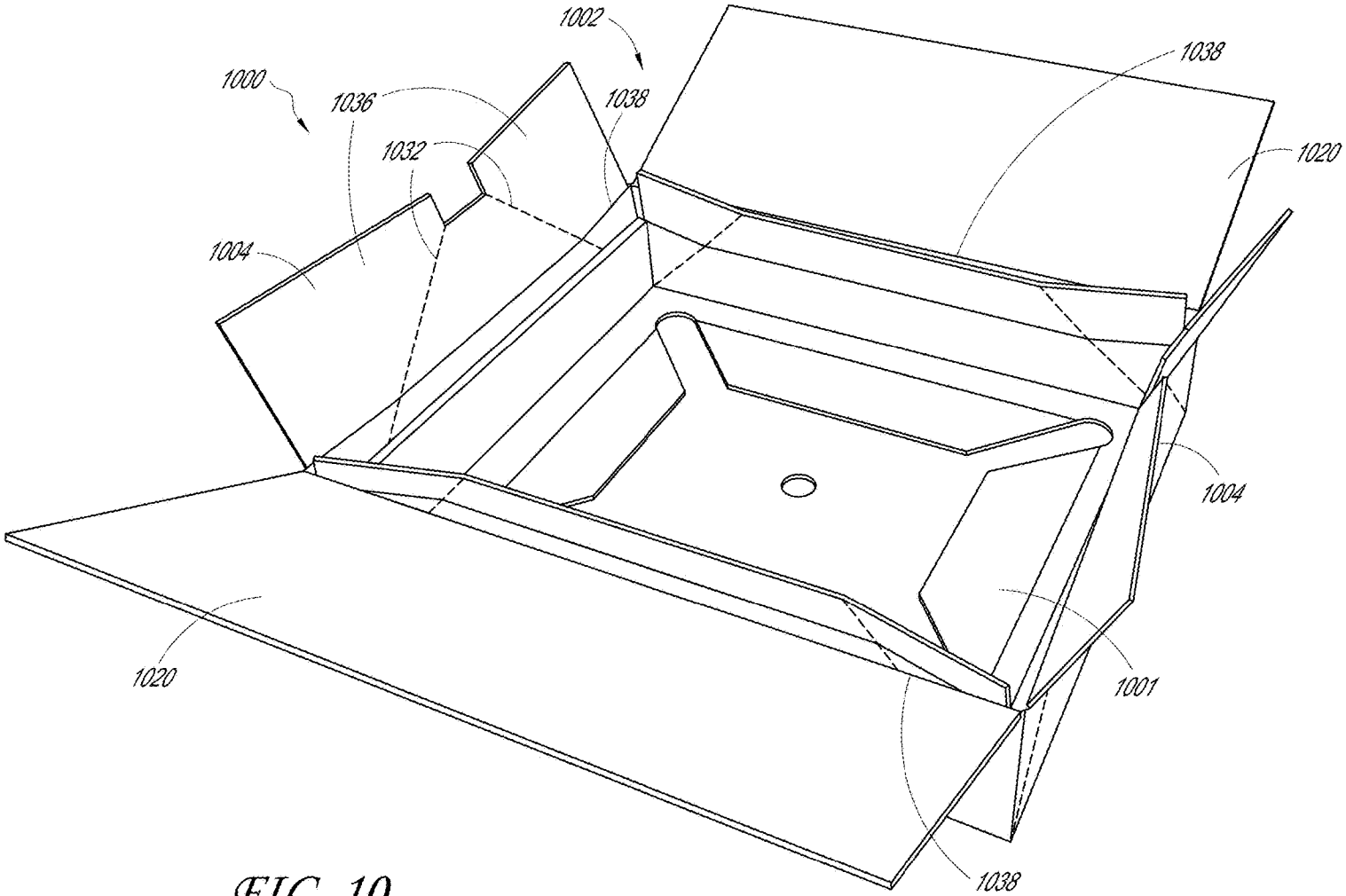
FIG. 10 is a perspective view of the collapsible shock absorbing frame nested within the outer container of FIG. 1.

Referring to FIG. 10, in some embodiments of the system 1000, collapsible shock absorbing frame 1001 is nestable within the outer container 1002 between the side walls 1004 and the end walls 1008. For example, the collapsible shock absorbing frame can fit within the confines of the side walls 1004 and the end walls 1008 and above the bottom panel 1012 of the outer container. In some embodiments of the packaging system 1000, the collapsible shock absorbing frame is nestable within the outer container 1002 and the outer container can be folded between the expanded state and the collapsed state with the collapsible shock absorbing frame 1001 contained therein. When the outer container is transitioned from the expanded state into the collapsed state, the side walls 1004 and the end walls 1008 of the outer container can be folded towards the bottom panel 1012 either along the bottom fold lines 1022 or the side fold lines 1018. In some such embodiments, when so folded, the side walls 1004 and/or the end walls 1008 force the side walls 1400 and 1500 of the collapsible shock absorbing frame member to fold inwardly. Also the folding of the side walls 1004 and the end walls 1008 can cause the end walls 1100 and 1200 of the collapsible shock absorbing frame member to fold inwardly towards the bottom 1300. As the outer container is transitioned from an expanded state into a collapsed state with the collapsible shock absorbing frame 1001 inside of the outer container 1002, the collapsible shock absorbing frame 1001 can be transitioned from an deployed state into the collapsed state.

When the outer container is transitioned from the collapsed state into the expanded state, the side walls 1004 and the end walls 1008 of the outer container can be folded away from the bottom 1012. In some such embodiments, when so folded, the side walls 1400 and 1500 of the collapsible shock absorbing frame member are allowed to fold outwardly. As the outer container is transitioned from the collapsed state into the expanded state, the collapsible shock absorbing frame can be or allowed to be transitioned from the collapsed state into the deployed state. The sequence of FIGS. 10-13 illustrate the compression of both of the outer container 1002 and the collapsible shock absorbing frame 1002.

Referring to FIG. 10, the collapsible shock absorbing frame 1001 has been placed within the outer container 1002 and the outer container 1002 is being configured from the expanded state into the collapsed state. In some embodiments, the end walls 1008 of the outer container 1002 can be folded in towards the bottom panel 1012. In some embodiments, with the collapsible shock absorbing frame placed or nested within the outer container 1002, the end walls 1008 can contact with the end walls 1100 and 1200 of the collapsible shock absorbing frame 1001. The folding of the end walls 1008 can engage end walls 1100 and 1200 and can cause them to fold towards the bottom panel 1300 of the collapsible shock absorbing frame along the first and second bottom fold lines 1308 and 1310. FIG. 11 illustrates the collapsible shock absorbing frame 1001 in a collapsed state or at least a partially collapsed state.

In FIG. 12, the end walls 1008 have been fully folded into the collapsed state along the side wall fold lines 1018 folding the end walls 1100 and 1200 of the collapsible shock absorbing frame 1001 into the collapsed state. The first and second top panels 1020 can be folded over to close the outer container 1002 into a closed state for shipping purposes. The closed state for shipping purposes is illustrated in FIG. 13 with the outer container 1002 in the collapsed state and the top panels 1020 folded over into a shipping state.

In the collapsed state, such as illustrated in FIG. 13, the outer container 1002 can be secured by means of an outer restraining mechanism such as tape or glue such that the outer container remains in the collapsed state. The use of such a retaining mechanism can in some cases be utilized because of the magnitude of forces tended to move the collapsible shock absorbing frame and/or the outer container when in the collapsed states, respectively, into the uncollapsed and expanded state, respectively.

In other embodiments of the system 1000, the collapsible shock absorbing frame 1001 can be placed within or nested within the outer container 1002 when in a locked configuration. As discussed further below, the locked configuration of the collapsible shock absorbing frame 1001 can maintain the collapsible shock absorbing frame in a deployed state. In some embodiments, when the collapsible shock absorbing frame 1001 in the locked configuration is placed or nested within the outer container, the outer container 1002 cannot be folded from an expanded state into a collapsed state. In such embodiments, the outer container 1002 can be closed into an expanded state for shipping purposes.

An embodiment of the packaging system 1000 can be implemented by a user for shipping purposes. For example, the user can receive the packaging system 1000 in the collapsed sate and can open the outer container 1002 by removing the retainer mechanism. This will allow for the outer container 1002 to be moved out of the collapsed state into the expanded state and the inner fame 1001 can be moved from the collapsed state into an deployed state. The collapsible shock absorbing frame 1001 can be removed from the outer container 1002 and an article for shipping can be placed within the outer container 1002. The collapsible shock absorbing frame 1001 can be configured into the locked configuration and the collapsible shock absorbing frame 1002 can be placed back within the outer container over the article with the collapsible shock absorbing frame 1001 functioning to maintain the article in place during shipping. For example, in some embodiments, the collapsible shock absorbing frame can comprise a retention sheet 1304 that helps to maintain the article in place. The article can be placed between the bottom panel 1300 and the retention sheet 1304, as described further below in relation to the retention sheet 1304.

In another embodiment of the system 1000, the user can place the article within the collapsible shock absorbing frame 1001 itself, and then place the collapsible shock absorbing frame 1001 within the outer container 1002 with the collapsible shock absorbing frame 1001 in the locked configuration.

In some embodiments, the bottom panel 1300 can comprise a plurality of pivotable flaps 1312. In some embodiments, the pivotal flaps can engage with the article for shipping and by the resiliency of the material of the inner container 1001 can keep the tension flaps in contact with the article for shipping thereby maintaining it in place within the outer container 1002. In such an embodiment, the retention sheet can comprise first and second ends 1305, 1306 attached to the end panels 1100, 1200 of the collapsible shock absorbing frame 1001. Alternatively, the ends 1305, 1306 of the retention sheet 1304 can be attached to one or both of the side panels 1400, 1500.

In some embodiments of the packaging system 1000, the user can place the article 103 within the outer container and the collapsible shock absorbing frame within the outer container and then convert the collapsible shock absorbing frame into the locked configuration. Finally, the user can close the outer container in the expanded state and seal it for shipping the article therein. As used herein with regard to the closing of the outer container, the term "seal" does not require an air-tight seal. Rather, the terms "seal" in this context refers to the closure of a cardboard box for mailing, in which some or all of the exposed corners or overlapping cardboard panels are taped or otherwise secured sufficiently for mailing.

In some embodiments of the return shipping system 1000, the collapsible shock absorbing frame 1001 replaces any other cushioning material that may be included within the outer container 1002. In other embodiments, cushioning material within the outer container can be supplemental to the collapsible shock absorbing frame 1002. The frame 1002 substantially protects an article for shipping 103 from drops and shock during transit. It performs this by ensuring that the article 103 is maintained in a cushioned position within the outer container 1002 and by providing shock absorption. For example, the resilient sheet 1304 can be placed over the article 103 and stretched around the contours of the article and thereby holding it in place. The resilient sheet 1304 can also provide shock absorption during drops. The flaps 1312 can similarly provide additional support to maintain the article 103 in place and shock absorption.

Figure 14:
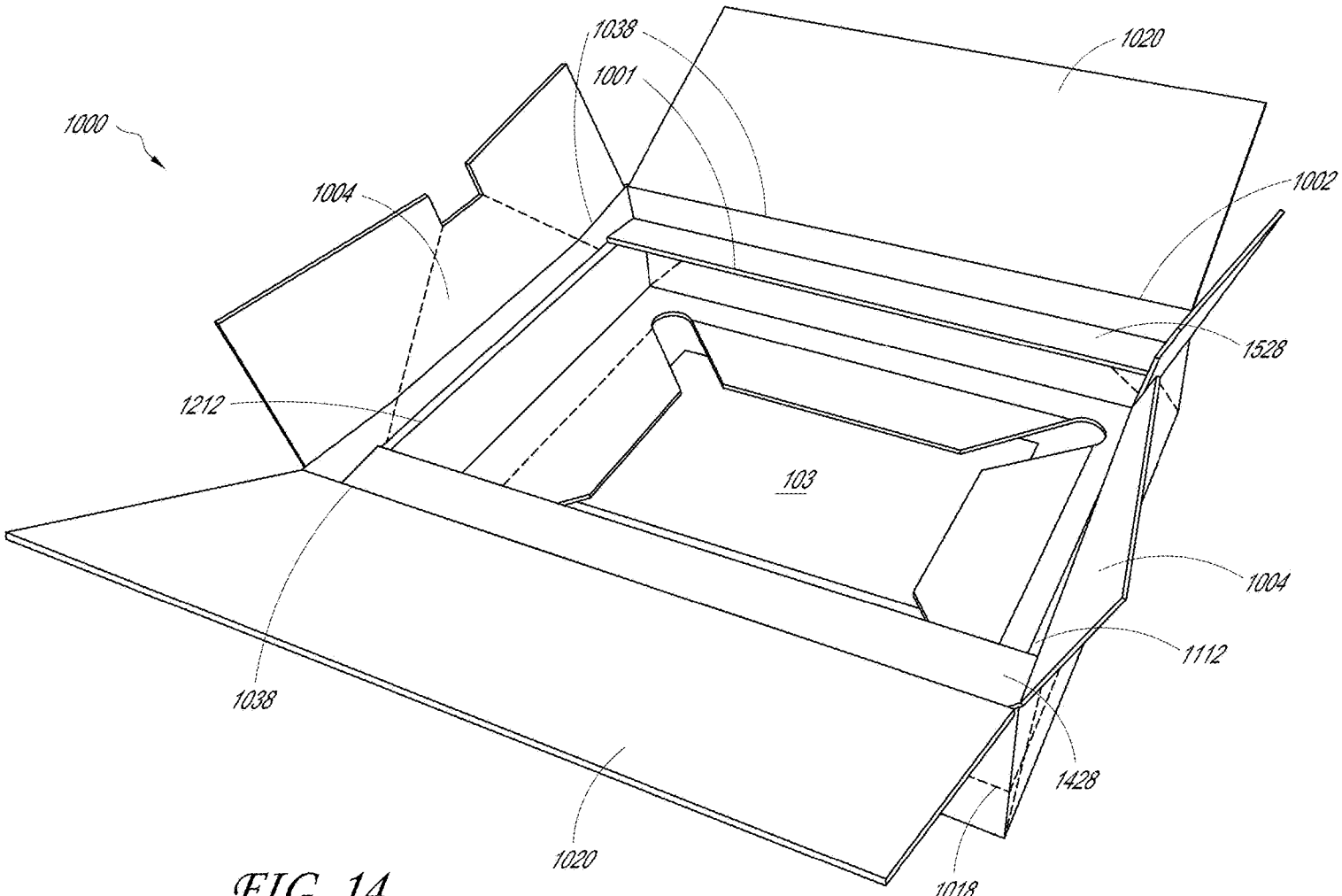
FIG. 14 is a perspective view of the collapsible shock absorbing frame of FIG. 1 in a deployed configuration and nested within an outer container.

FIGS. 14 and 15 illustrated the collapsible shock absorbing frame 1001 in the locked configuration and nested within the outer container 1002. In some embodiments, the locking fold line 1424 is above the fold lines 1018 in the side walls 1004 and the end walls 1008 and/or above the bottom fold lines 1022. Thus, in some embodiments, the outer container cannot be folded into the collapsed state because of interference from inner container 1001 in the locked configuration.

In some embodiments of the system 1000, the collapsible shock absorbing frame 1001 can be placed within the outer container 1002 and the top flaps 1020 of the outer container can be folded to close the outer container into a shipping configuration when in the expanded state. In some embodiments, the folding of the top flaps 1020 can fold or cause to be folded the locking portion 1428 along the locking fold line 1424 to move the collapsible shock absorbing frame into the locked configuration and/or to retain the collapsible shock absorbing frame in the locked configuration during shipping of an article.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

What is claimed is:

1. A return-shipping container system for shipment to a customer in an empty state and for return shipment of an item with shock-protection during transport, comprising:

a collapsible shock absorbing assembly including a central panel having a central aperture, a peripheral wall extending along a periphery of the central panel, the peripheral wall comprising first, second, third, and fourth wall panels pivotably attached to the central panel, the first and third wall panels disposed at opposite ends of the central panel and the second and fourth wall panels disposed at opposite sides of the central panel;

the peripheral wall being foldable between a deployed position and a collapsed position, wherein in the deployed position the first, second, third, and fourth wall panels extend generally perpendicular to the central panel defining a deployed height of the collapsible shock absorbing assembly, and wherein in the collapsed position the peripheral wall is folded against the central panel and defines a collapsed height that is smaller than the deployed height;

wherein the second and fourth wall panels each comprise first and second diagonal fold creases, respectively, the second and fourth wall panels being configured to fold along the first and second diagonal fold creases from the deployed to the collapsed positions, forming first and second triangular overlapping portions on each of the second and fourth wall panels;

a resilient sheet having first, second, third, and fourth edge portions, the first and third edges of the resilient sheet being connected to the first and third wall panels and the second and fourth edges of the resilient sheet lying adjacent to the second and fourth wall portions;

a contractible outer container, foldable between contracted and expanded configurations, wherein in the expanded configuration, the contractible outer container defines an expanded interior cavity sufficiently large to receive the entire collapsible shock absorbing assembly in the deployed position and an additional article of commerce, and wherein when the contractible outer container is in the contracted configuration, the contractible outer container defines a contracted interior cavity that is too small to receive the entire collapsible shock absorbing assembly in the deployed configuration but is sufficiently large to receive and enclose for shipping the entire collapsible shock absorber absorbing assembly in the collapsed position.

2. The shipping container of claim 1, the contractible outer container further comprising:

a bottom wall and a plurality of container side walls connected to the bottom wall, each container side wall of the plurality of container side walls comprises a lower portion and an upper portion, the upper portion pivotably connected to the corresponding lower portion along a horizontal fold line and the lower portion connected to the bottom wall; and wherein folding of the plurality of container side walls along the horizontal fold lines transitions the outer container from the expanded state into the contracted state.

3. The shipping container of claim 2, wherein the contractible outer container is assembled with the collapsible shock absorbing assembly and folding of the plurality of container side walls of the contractible outer container along the horizontal fold lines folds the first and third wall panels of the peripheral wall inwardly towards the central panel and thereby transitions the peripheral wall of the collapsible shock absorbing assembly into the collapsed position.

4. The shipping container of claim 2, wherein:

the second and fourth wall panels of the collapsible shock absorbing assembly each comprise a horizontal locking fold line extending across the first and second diagonal fold creases, the locking fold line defining a locking portion on each of the second and fourth wall panels; and the locking portions being foldable between a locked position wherein the second and fourth wall panels cannot be folded along the first and second diagonal fold creases, respectively, and an unlocked position wherein the second and fourth wall panels are foldable along the first and second diagonal fold creases.

5. The shipping container of claim 4, wherein:

the contractible outer container further comprises first and second top panels pivotably coupled at top fold lines with corresponding upper portions of the container side walls of the plurality of container sides walls; and the contractible outer container is assembled with the collapsible shock absorbing assembly and folding of the first and second top walls of the outer container along the top fold lines folds the locking portions of the second and fourth wall panels inwardly along the locking fold lines, the locking portions extending above the top fold lines.

6. The shipping container of claim 4 wherein the contractible outer container is assembled with the collapsible shock absorbing assembly and the locking fold lines are aligned with a top ridge of each of the first and third wall panels of the collapsible shock absorbing assembly such that the locking portions can be folded down below the top ridges.

7. The shipping container of claim 1 wherein the first and second diagonal fold creases are set at a 45° angle with respect to the periphery of the central panel of the collapsible shock absorbing assembly.

8. A shipping container for containing and protecting an article during transport, comprising:

a collapsible shock absorbing frame comprising a central panel and a plurality of side panels, each side panel of the plurality of side panels connected with the central panel along corresponding bottom fold lines, the collapsible shock absorbing frame having a collapsed configuration, wherein the plurality of side panels are folded towards the central panel, and a deployed configuration, wherein the plurality of side panels are upright with respect to the central panel;

an outer container comprising a bottom panel and a plurality of side walls, the side walls of the outer container being foldable between at least first and second states, the collapsible shock absorbing frame being nestable within the outer container when in either of the first and second states, the first state of the outer container enclosing a first volume of space sufficient to encompass the collapsible shock absorbing frame in the collapsed configuration and insufficient to encompass the collapsible shock absorbing frame in the deployed configuration, the second state of the outer container enclosing a second volume of space sufficient to encompass the collapsible shock absorbing frame when in either of the deployed and the collapsed configurations.

9. The shipping container of claim 8, further comprising: a first side panel of the plurality of side panels of the collapsible shock absorbing frame, the first side panel comprising a central portion and first and second diagonal folding lines defining first and second triangular portions, respectively.

10. The shipping container of claim 9, further comprising: a locking fold line extending across the first side panel and defining a locking portion of the first side panel;

wherein the locking portion is folded along the locking fold line to transition the deployed configuration to a locked configuration in which the collapsible shock absorbing frame cannot be folded in the collapsed configuration.

11. The shipping container of claim 10, wherein the locking fold line extends across the central portion and the first and second triangular portions of the first side panel, the locking fold line aligned with a first and a second top ridge of a second and a third side panel of the plurality of side panels, respectively.

12. The shipping container of claim 10, further comprising: a resilient sheet member having first and second edges, the first edge coupled with the first side panel and the second edge coupled with a third side panel of the plurality of side panels and extending across a central aperture of the bottom panel of the collapsible shock absorbing frame.

13. The shipping container of claim 12, wherein the first edge is coupled with the locking portion of the first side panel, the locking portion configured to apply a tension to the resilient sheet member when folded inwardly along the locking fold line.

14. The shipping container of claim 10, wherein:

each of the plurality of side walls of the outer container comprises a lower portion and an upper portion, the upper portion pivotably connected to the corresponding lower portion along a fold line and the lower portion connected to the bottom panel, the fold line spaced above the bottom panel; and the outer container is assembled with the collapsible shock absorbing frame and folding of the plurality of side walls of the outer container along the fold lines transitions the outer container from the second state to the first state and causes the collapsible shock absorbing frame to fold into the collapsed configuration by folding second and fourth side panels of the plurality of side panels inwardly towards the central panel.

15. The shipping container of claim 10, wherein:

each of the plurality of side walls of the outer container comprises a lower portion and an upper portion, the upper portion pivotably connected to the corresponding lower portion along a fold line and the lower portion connected to the bottom panel, the fold line spaced above the bottom panel; and the outer container is assembled with the collapsible shock absorbing frame and folding of the plurality of side walls of the outer container along the fold lines is prevented by the collapsible shock absorbing frame in the in the locked configuration.

16. The shipping container of claim 15, wherein:

the outer container comprises a top panel pivotably coupled at a top fold line with a corresponding side wall of the plurality of side walls; and the outer container is assembled with the collapsible shock absorbing frame and the locking fold line of the collapsible shock absorbing frame is positioned above the fold line of the plurality of side walls and at or below the top fold line.

17. The shipping container of claim 16, wherein the outer container is assembled with the collapsible shock absorbing frame, the locking portions extending above the top fold lines and folding of the top panel along the top fold line causes the locking portion of the first side panel of the collapsible shock absorbing frame to fold along the locking fold line and thereby transition the inner frame into the locked configuration.

18. A collapsible shock absorbing frame comprising:

a bottom panel;

a first end panel and a second end panel, the first and second end panels coupled with the bottom panel at first and second bottom fold lines, respectively;

a first side panel and a second side panel, the first and second side panels coupled with the bottom panel at third and fourth bottom fold lines, respectively;

the first side panel comprising a central panel and first and second triangular portions defined by respective diagonal fold lines;

a resilient sheet having first and second ends attached to the first and second side panels, respectively;

the collapsible shock absorbing frame having a collapsed configuration and a deployed configuration, wherein in the collapsed configuration, the central panel of the first side panel is folded towards the bottom panel along the third bottom fold line and the first and second triangular portions are folded outwards along the diagonal fold lines and overlapping a portion of the central panel;

the collapsible shock absorbing frame having a deployed configuration wherein first side panel is upright with respect to the bottom panel.

19. The collapsible shock absorbing frame of claim 18, wherein:

the first side panel comprises a locking fold line extending horizontally across the central panel and the first and second triangular panels, the locking fold line defining a foldable locking portion on the first side panel; and folding the locking portions along the locking fold lines prevents the first and second triangular portions from folding along the diagonal fold lines.

20. The collapsible shock absorbing frame of claim 19, wherein the bottom panel comprises a central opening, a middle portion of the resilient sheet extending across the central opening, and when in the collapsed configuration, the first and second side panel apply a tension across the resilient sheet.

21. The collapsible shock absorbing frame of claim 20, wherein the first and second ends of the resilient sheet are heat sealed to the first and second side panels, respectively.

22. The collapsible shock absorbing frame of claim 20, wherein the first end of the resilient sheet is connected with the locking portion of the first side panel and the locking portion applies a tension across the resilient sheet when folded along the locking fold line.

23. The collapsible shock absorbing frame of claim 19, wherein one end of the locking fold line is aligned with a top ridge of the first end panel and a second end of the locking fold line is aligned with a top ridge of the second end panel.

24. The collapsible shock absorbing frame of claim 18, further comprising:

an inner panel and an outer panel of the first end panel, the outer panel pivotably coupled with the bottom panel at the first bottom fold line and pivotably coupled with inner panel at a ridge fold line;

a first flap portion, the first flap portion pivotably coupled with the first triangular panel at a first flap fold line; and wherein the inner panel is folded inwardly along the ridge fold line and adjacent to the outer panel, the first flap portion secured therebetween.

25. The collapsible shock absorbing frame of claim 18 wherein the first diagonal fold line intersects the third bottom fold line at the first end panel and the second diagonal fold line intersects the third bottom line at the second end panel.

26. The collapsible shock absorbing frame of claim 25 wherein the first diagonal fold line extends at a 45° angle from the third bottom fold line.

* * * * *